United States Patent [19]

Shibazaki et al.

[11] Patent Number: 5,045,830

[45] Date of Patent: Sep. 3, 1991

[54] HYDRAULIC ACTUATING APPARATUS

[75] Inventors: Toshiji Shibazaki; Junio Chuzenji; Mikio Sasahara; Masaru Okano; Yoshihiro Ozaki; Naoto Kishida, all of Saitama, Japan

[73] Assignee: Toyo Denso Kabushiki Kaisha, Tokyo, Japan

[21] Appl. No.: 297,448

[22] Filed: Jan. 17, 1989

[30] Foreign Application Priority Data

| | | | |
|---|---|---|---|
| Jan. 18, 1988 | [JP] | Japan | 63-4501[U] |
| Jan. 18, 1988 | [JP] | Japan | 63-4503[U] |
| Feb. 15, 1988 | [JP] | Japan | 63-18619[U] |
| Feb. 15, 1988 | [JP] | Japan | 63-18620[U] |
| Feb. 15, 1988 | [JP] | Japan | 63-18621[U] |
| Feb. 15, 1988 | [JP] | Japan | 63-18622[U] |
| Apr. 16, 1988 | [JP] | Japan | 63-51486[U] |
| Jun. 30, 1988 | [JP] | Japan | 63-87615[U] |

[51] Int. Cl.[5] ..... H01C 10/10

[52] U.S. Cl. ..... 338/41; 338/36; 73/862.58; 92/34

[58] Field of Search ..... 338/36, 42, 41; 73/862.58; 92/34, 40, 41, 43, 44

[56] References Cited

U.S. PATENT DOCUMENTS

| | | | |
|---|---|---|---|
| 4,117,724 | 10/1978 | Cook | 73/386 |
| 4,279,162 | 7/1981 | Neill | 73/746 |
| 4,284,969 | 8/1981 | Carbonneau | 338/183 |
| 4,365,406 | 12/1982 | Neill | 29/593 |
| 4,433,321 | 2/1984 | Widdowson | 338/42 |
| 4,449,012 | 5/1984 | Voser | 174/70 |
| 4,479,107 | 10/1984 | Bleeke | 338/176 |
| 4,525,698 | 6/1985 | Louis | 338/39 |
| 4,648,277 | 3/1987 | Obermann | 73/725 |

*Primary Examiner*—Marvin M. Lateef

*Attorney, Agent, or Firm*—Armstrong, Nikaido, Marmelstein, Kubovcik & Murray

[57] ABSTRACT

A hydraulic actuating apparatus includes a cylindrical case having a fitting at one end connectable to a source of pressurized oil, the fitting having a passage for communication with the pressurized oil, a slider slidably carried by the cylindrical case, the slider being slidable in response to the oil pressure, a first spring device for biasing the slider in a predetermined direction to resist the force on the slider applied by the oil pressure, a slidable contact device carried by the slider, an oil pressure sensor which includes a resistor and a ground conductor, the slidable contact device being slidably engaged with the resistor, the resistor being fixed with respect to the slidable contact device, and a second spring device for biasing the slider in the predetermined direction. The second spring device is connected to the slider, with the second spring device having a smaller spring constant than the first spring device. The hydraulic actuating apparatus further includes a fuel pump switch having a movable contact and a fixed contact, wherein movement of the movable contact relative to the fixed contact causes one of contact and release of the fuel pump switch, the fuel pump switch is assembled integrally in the case, and the resistor includes a flat resistor.

19 Claims, 26 Drawing Sheets

HYDRAULIC ACTUATING APPARATUS

BACKGROUND OF THE INVENTION

The present invention relates to a hydraulic actuating apparatus for motor vehicles in which an oil pressure sensor and a fuel pump switch are integrally assembled into a same case.

PRIOR ART

In a prior used hydraulic actuating apparatus an oil pressure sensor consists of a diaphragm provided at an outlet of an oil passage made within a case, a slider moved by the diaphragm, a fork formed slide contacting plate installed in the slider, a coil typed resistor housed in the case in such a manner that each free end of the slide contacting plate is capable of a slide contact and a coil spring one end of which is supported at the slider, and a fuel pump switch consists of a movable contact supported at the other end of the coil spring under insulating condition, a fixed contact, which is capable of contact and release with the movable contact, provided in the projecting portion of a coupler into the case in which the fixed contact is inserted into one end of the case, and a plate spring which bias the fixed contact to release from the movable contact. The plate spring is considerably weaker than the coil spring. At the first stage when oil pressure is supplied in the oil pressure passage, the slider is moved and the plate spring changes through the coil spring to contact the movable contact with the fixed contact so that the fuel pump switch turns on. Increasing the oil pressure, the slider moves corresponding to the oil pressure through compressing the coil spring and the slide contacting plate moves on the resistor so that the resistance changes in proportion to the oil pressure. The resistance can be shown in the oil pressure meter (not shown in the drawing) as the oil pressure level.

SUMMARY OF THE INVENTION

As the resistor has a coil shaped figure, the output resistance has a little by little wave shaped alternation as shown in FIG. 13. As the resistance changes in the wave form and it is hard for the driver to look at the indication of the fuel meter because of the alternation thereof, it become desirable to take off the wave shaped alternation. It is a main object of the present invention to avoid the wave shaped alternation. It is, further, desirable that the oil pressure alternation to the movement of the slider could be linear in proportion. However, in a practical manner, under the large movement of the slider the air pressure within the case increases by the heat expansion of the air and it becomes the resistance to the slider movement, resulting in that the indication goes out of the linear characteristics.

It is another object of the present invention that the oil pressure alternation could be linear to the slider movement. The resistor, which is slidably contacted with the slide contacting plate, a ground conductor are respectively connected to the terminals in the coupler and causes difficulty in the electrical wiring and a longer assembly time.

It is another object to provide a beneficial electrical wiring of the ground conductor.

In order to achieve the above objects the present invention employs a flat surface resistor so that the slide contacting plate can move smoothly on the flat surface resistor and the resistance alters smoothly. It can bring an accurate indication of the oil pressure meter and good visibility thereof.

In case of employing a wire-brush for the contacting portion of the slide contacting plate, if the slide contacting plate inclines, some of the wire brush can keep contact with the flat surface resistor so that it can improve the contacting condition.

Furthermore, the slide contacting plate is constituted so as to selectively contact a plurality of conductors provided within the sliding zone which are vertical to the sliding direction and the conductors contact the resistor provided out of the sliding zone. It can make a output of the resistor the step function and in spite of the oil pressure pulsation the indication of the meter can be stable. As the resistor is in a non-contact relation with the slide contacting plate, the resistor is not worn off by the slide contacting plate and the endurance of the apparatus can be definitely improved. As the diaphragm contacts with the slider through the curved surface portion, the slider and the movable conductor are hard to incline in respect to the actuating axis direction without the inclining movement and the swinging movement of the diaphragm with respect to the actuating axis direction, resulting in that it can always keep the contacting pressure of the contact portion at a constant level and can prevent the partial wear of the contacting portion, the deforming thereof and bad electrical conduction. To employ a pressure cancel device against the inside pressure increase can establish the substantially linear relationship between the alternation of the slider movement and of the oil pressure. Further, the alternation of the slider movement can be substantially linear to the oil pressure and it can improve the reliability of the oil meter. To make the cancel element water proof and to water proof the case inside, the variable resistor device has a body ground construction formed by connecting the ground conductor to the case, which can reduce number of parts and facilitate the assembly work. The extending portion of the ground conductor is connected on the other circumference of the coupler extending portion so that it can be connected to the case by the insertion thereof at the same time. The fuel pump switch employs the reverse spring and the actuating direction of the switch press element aligns with the slider movement direction so that it can reduce the hysteresis at an on-off switch timing and improve the actuating accuracy.

Other objects and effects of the present invention will be descrived in the following.

BRIEF EXPLANATION OF THE DRAWINGS

FIG. 1 is a outside perspective view.

FIG. 2 is a developed perspective view.

FIG. 3 is a vertical sectional view.

FIG. 4 is a right side view.

FIG. 5 is a sectional view along with line V—V of FIG. 3.

FIG. 6 is a partially developed perspective view.

FIG. 7 is a partially vertical view.

FIG. 8 is a partially perspective view.

FIG. 9 is a partially developed perspective view.

FIG. 10 to FIG. 12 are partially perspective views.

FIG. 13 is a graph showing the alternation of the resistance to the oil pressure.

FIG. 14 is a vertical sectional view.

FIG. 15 is a right side view.

FIG. 16 is a partially enlarged vertial view.

FIG. 18 is a partially enlarged vertical view.

FIG. 19 is a partially developed perspective view.

FIG. 20 is a vertical sectional view.

FIG. 21 is a sectional view along with line XI—XXI of FIG. 20.

FIG. 22 is a vertical view along with line XXII—XXII of FIG. 20.

FIG. 23 is a partially enlarged vertical view.

FIG. 24 is a partially perspective view.

FIG. 25 is a vertical sectional view of a hydraulic actuating apparatus.

FIG. 27 is partially plain view.

FIG. 28 is a sectional view along with line XXVIII—XXVIII of FIG. 27.

FIG. 29 is a partially enlarged view.

FIG. 30 is a partially plain view.

FIG. 31 is a sectional view along with line XXXI—XXXI of FIG. 30.

FIG. 32 is a graph showing the alternation of the resistance.

FIG. 33 is a vertical sectional view of a whole apparatus.

FIG. 34 is a partially perspective view.

FIG. 35 is a partially enlarged view showing the function.

DESCRIPTION OF PREFERRED EMBODIMENTS

Figure 1:
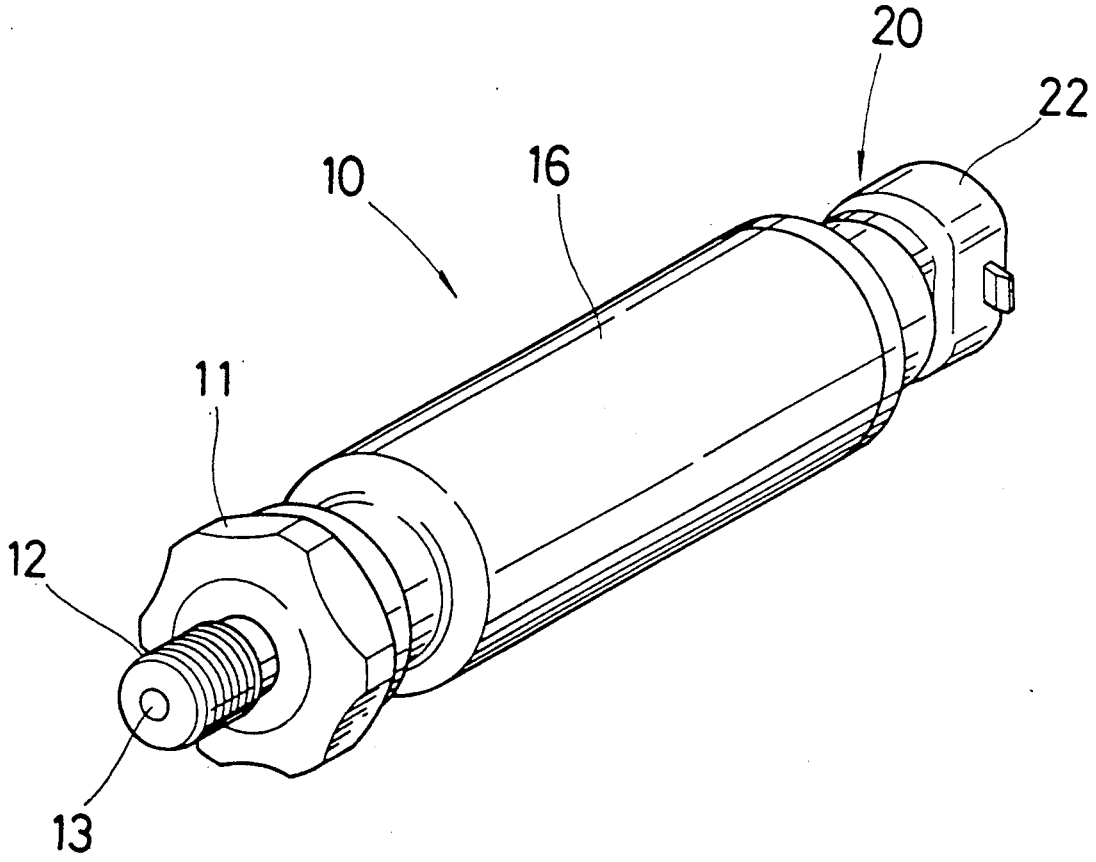
FIG. 1 to FIG. 13 show a first preferred embodiment.
Figure 2:
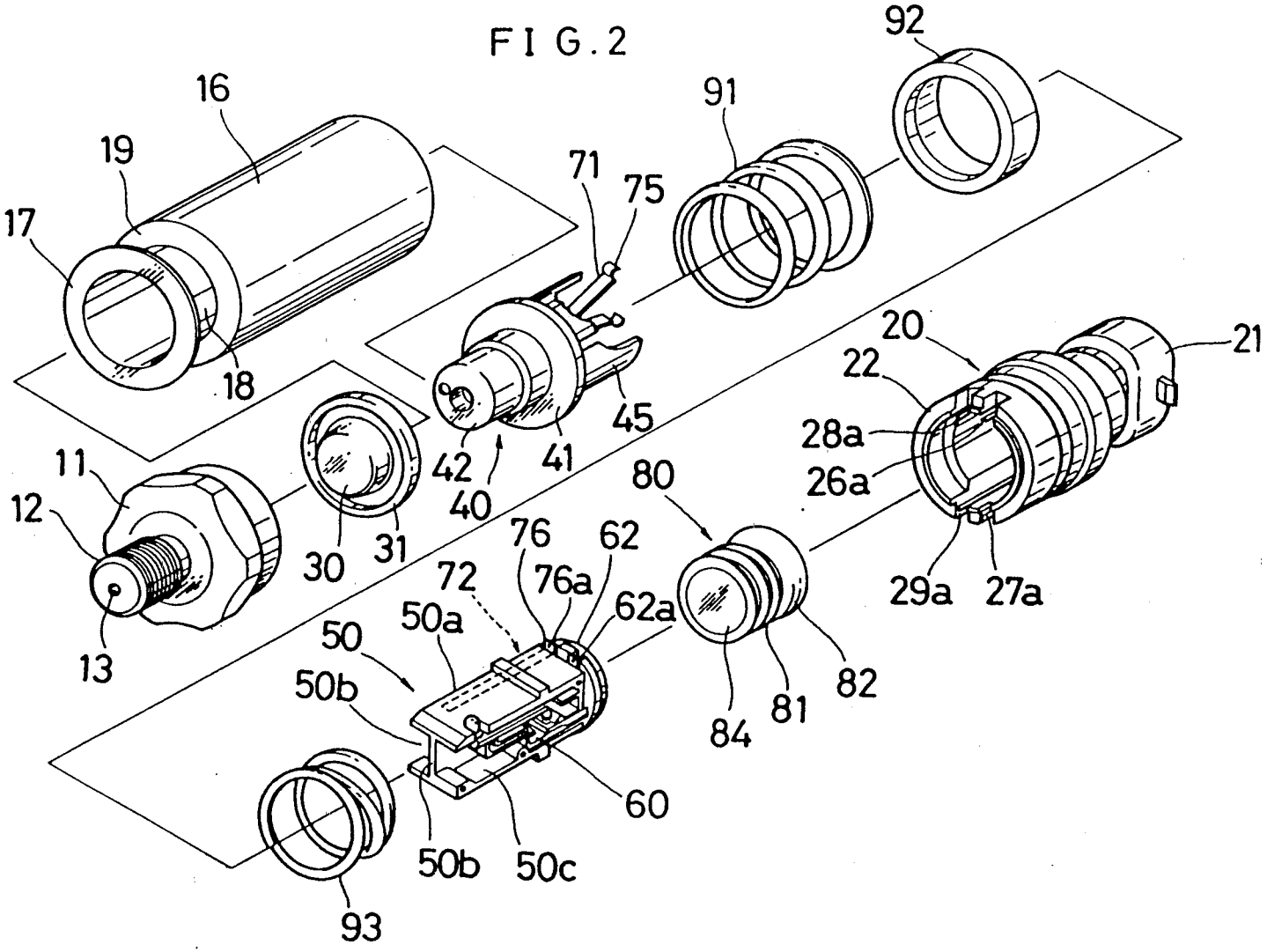

FIG. 1 to FIG. 13 show a preferred embodiment of the present invention. A hydraulic actuating apparatus outside view in FIG. 1 shows an integrated fuel pump switch which makes a fuel pump turn on and off, and includes a variable resistance device which detects the oil pressure and indicates it on the oil pressure meter provided at another place. This apparatus is assembled as shown in FIG. 2 showing each of the disassembled parts and in FIG. 3 in a vertical sectional view. There is shown a coupler 20 in FIG. 1, installed at one end of a case 10.

The case 10 includes a base portion 11 for connection to an oil pressure circuit of an oil pump not shown in the drawing, and a cylindrical portion 16. A diaphragm 30, a slider 40, an unmoved body 50, a pressure cancel device 80, and a return spring device 90. A fuel pump switch 60 and a variable resistance device 70 (shown in FIG. 5) are respectively provided at one end and the other end of the unmoved body 50. The detailed construction of each portion will be described in the following.

Figure 3:
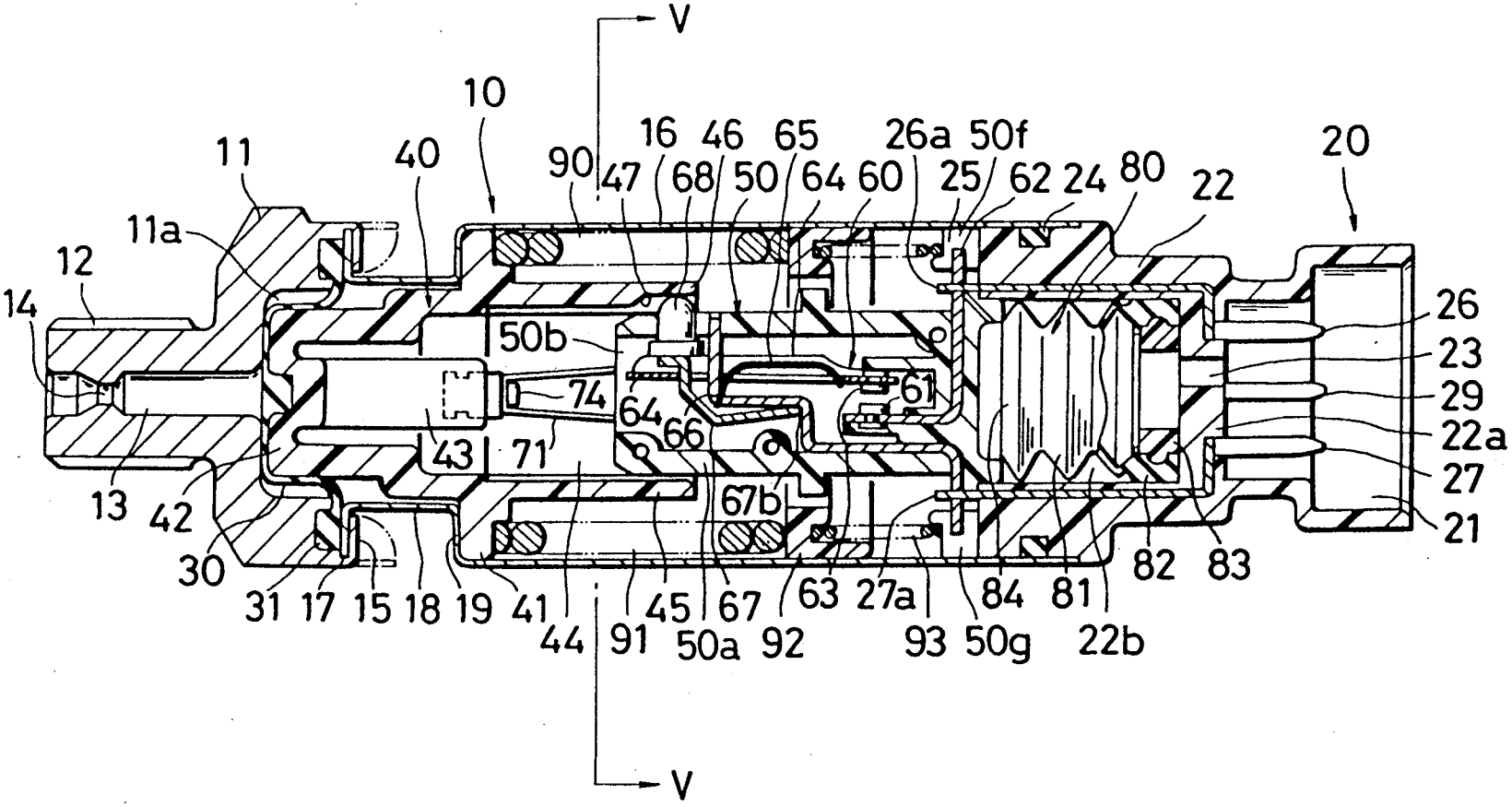

As shown in FIG. 3, which is a vertical sectional view showing a fuel pump switch 60 of the hydraulic actuating apparatus, a mouth metal 11 has a bottom portion and a screw fitting portion 12 in the center portion of which an oil pressure passage 13 is made. A jet portion 14 is formed by narrowing of a part of the oil pressure passage 13. The fitting screw portion 12 is connected to the oil pressure circuit and the jet portion 14 has the function of controlling the pulsation of the pressurized oil which is supplied from the oil pump to the oil pressure passage 13. A clamping portion 15 with an inward flange is made at the connecting portion between the mouth metal 11 and the cylindrical portion 16 and overlaps an outward flange portion 17 formed at one end of the cylindrical portion 16, the flange portion 17 and the clamping portion 15 being adjacent when assembled. As shown in FIG. 3 with two dashed lines line, the clamping portion 15 can be obtained by turning up inwardly an annular wall portion which was previously made. Numeral 18 in the drawing is (an annular recess) to (permit turning) up of the clamping portion opposed to the flange portion 17.

The coupler 20 includes a coupler portion 21 at one end and an extending portion 22 extending into the case 10 at the other end. The coupler 20 is divided into right and left compartments by a separating wall 22*a*. A space 22*b* is formed in the projecting or extending portion 22 which encloses a pressure cancelling device 80. The space 22*b* is a cylindrical space and extends to the bottom of the separating wall 22*a*. The space 22*b* can communicate with the interior of a coupler portion 21 through an atmospheric opening 23. The inward end of the extending portion 22 is inserted into the inner side of the tip end portion of the cylindrical portion 16 and is tightly connected thereto by means of a seal element 24.

Figure 4:
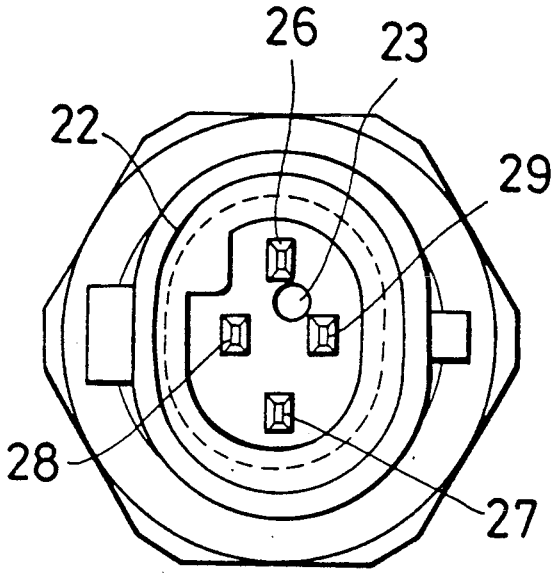

A spring receiving portion 25 is made at the opening end portion of the extending portion 22. There is made a cutting ditch in the spring receiving portion 25 in the radius direction, which is capable of stopping the conductive end portion. The coupler portion 21 houses four connecting terminals 26 to 29 as shown in FIG. 4 showing the right side view of the whole appatratus. A diaphragm 30 is housed in the recess 11*a* of the mouth metal 11 to shut the inside opening portion of the oil pressure passage 13 and a comparatively wide rim portion 31 is integrally formed at the circumferential edge portion. It is put between the edge surface of the mouth metal 11 and the flange portion 17 to make a complete liquid seal.

The slider 40 is a cylindrical element with a bottom and is housed within the diaphragm 30. When the pressurized oil is supplied to the oil pressure passage 13, it moves in the right direction in the drawing with the diaphragm 30.

A flange 41 is provided at the outer peripheral portion of the slider 40 and serves the dual functions of a stopper against the step portion 19 when it moves in the left direction and of a spring receiver. A boss 43 is integrally formed at a position offset the center of a bottom portion 42.

A thin wall portion 46 is made at the inside tip end portion of a part of an annular wall portion 45. Referring to FIG. 3, this annular wall portion 45 which extends from the flange 41 to the right in the drawing and defines a sliding space 44 there inside.

Figure 5:
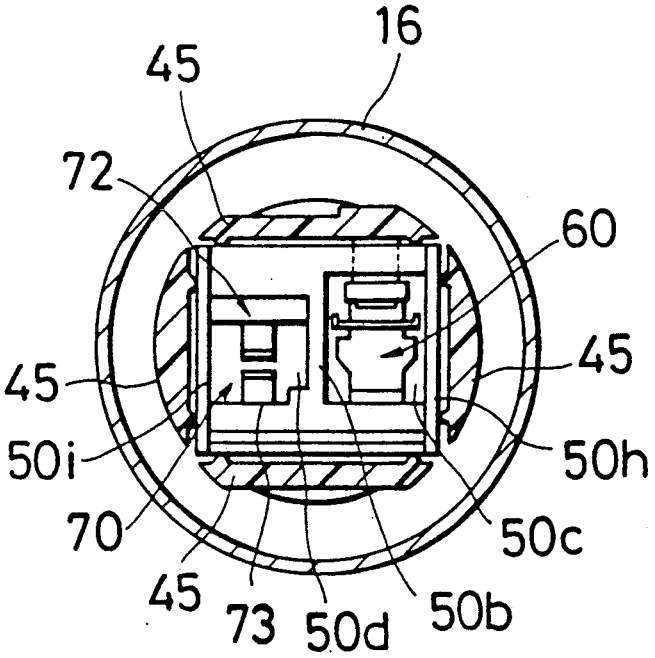

An unmoved body 50, as shown in FIG. 5, has a sectional portion in the shape of the letter "H" and an extending portion 50*a* which is capable of being inserted into the sliding space 44, and is divided into either spaces 50*e* and 50*d* at either side of a separating wall 50*b*. This houses the fuel pump switch 60 having a microswitch with a reverse spring within the space 50*e*, as shown in FIG. 6 which shows assembly of the fuel pump switch 60 to the unmoved body 50.

The fuel pump switch 60 has a bent plate element 62 which is a conductor with a fixed contact 61 at one end thereof, a frame shaped movable contact plate 64 which has a movable contact 63 at one end and an elongated spring 64*a*, a conductive supporting plate 66 which is bent at several locations and is connected through the movable contact plate 64 and the reverse spring 65, a swing plate 67 one end of which is supported on the supporting plate 66, and a pin element 68 with a step which can make one end of the swing plate move up and down. One end 65*a* of the reverse spring 65 is connected to the end portion of the elongated opening 64*a* at the movable contact side 63, and the other end 65*b* of the reverse spring 65 is connected to a hole portion 66*b* formed at the upper stage portion of the supporting plate 66 extending upwardly through the elongated opening 64*a*. The upper end portion 67*a* of the swing plate 67 also extends upwardly through the elongated opening 64*a* and is bent transversely to form a receiving portion to which the flange portion 68*a* of the pin element 68 is connected. The lower end portion 67*b* of the swing plate 67 is connected to the hole 66*a* formed at the upper stage of the supporting plate 66. Connecting holes 66*d* and 62*a* are respectively made at the lower end portion of the supporting plate 66 and at the upper end portion of the bent plate element 62. The end portions 26*a* and 27*a* of the terminals 26 and 27 are respectively received in the connecting holes 66*d* and 62*a*.

Figure 6:
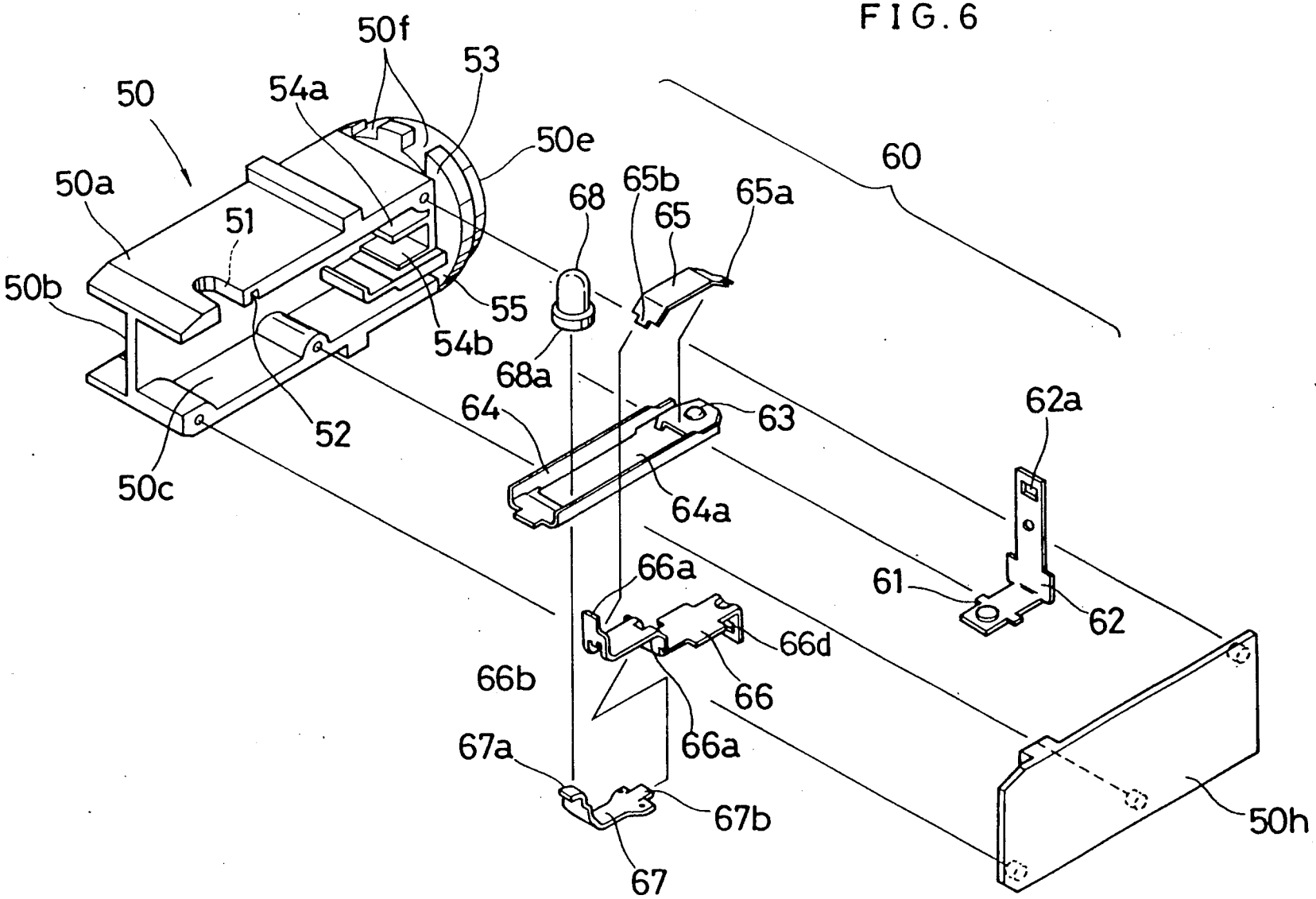

FIG. 6, shows a recess 51 through which the head portion of the pin element 68 is inserted to permit movement therethrough, 52 is a slot to receive the upper end portion 66*a* of the supporting plate 66, 53 is recess formed at the boundary portion of the unmoved body 50 in the end wall 57, 54*a* is a stopper integrally formed with the extending portion 50*a* to restrict the upward movement of the movable contact 63, 54*b* is an extending portion to support the fixed contact 61 and 55 is a recess to receive the lower end portion of the supporting plate 66. Recesses 50*f* and 50*g* formed on the mouth metal 50*e* provided to pass through the end portions 26*a* and 27*a* of the terminals 26 and 27, and are aligned with the holes in the conductors such as the hole 62*a* of the bent plate element 62. A cap 50*h* covers the side portion of the space 50*c* and a ridge is (unnumbered) at the inner side thereof. The cap 50*h* is fitted formed so that the ridge extends partially into when assembled, the recess 51 of the extending portion 50*a*.

Figure 7:
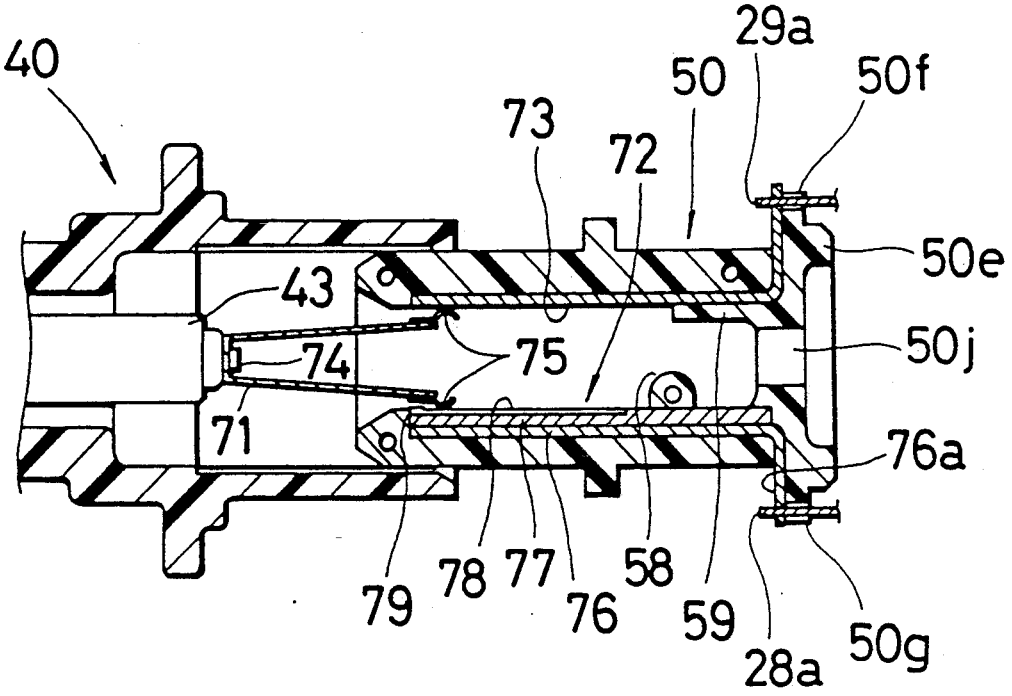
Figure 8:
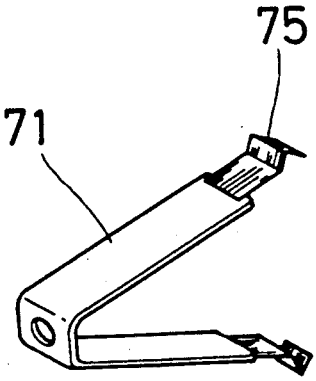
Figure 9:
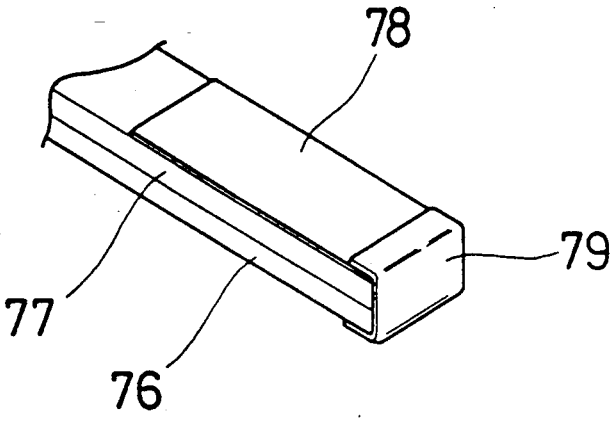

A variable resistor 70 is housed within the space 50*d*. FIG. 7 shows a partially vertical sectional view of the variable resistor 70 shifted 180° from FIG. 3. The variable resistor 70 consists of a slide contacting plate 71, a flat surface resistor 72 and ground conductor 73. As shown in FIG. 8, the slide-contacting plate 71 is made of a plate spring element which is forked and has a free end which has an opening. The center portion of the slide contacting plate is installed on a summit portion of the boss 43 of the slider 40 by a clamping element 74, as shown in FIG. 7. A wire brush 75 is welded at both free ends of the slide contacting plate 71, which is composed of a plurality of thin wires in a brush configuration. The flat surface resistor 72 includes a known type of resistor layer 78. This resistor layer 78 can, for example, be a mixed metal made of carbon and alumina which is formed as a flat plate on an insulating ceramic layer 77 which is put on a metal conductor 76. The resistor layer 78 is connected for conduction with the metal conductor 76 at a tip end thereof by solder 79. The ground conductor 73 is made of a suitable metal conductor. Each end portion of the flat surface resistor 72 and the ground conductor 73 are respectively connected for conduction at the end portions 28*a* and 29*a* of the terminal 28 and 29 respectively since both end portions of the slide contacting plate 71 are respectively in contact with the ground conductor 73 and the resistor layer 78, the circuit resistance can be altered by moving the slide contacting plate 71 together with the slider 40 relative to the body 50.

Figure 10:
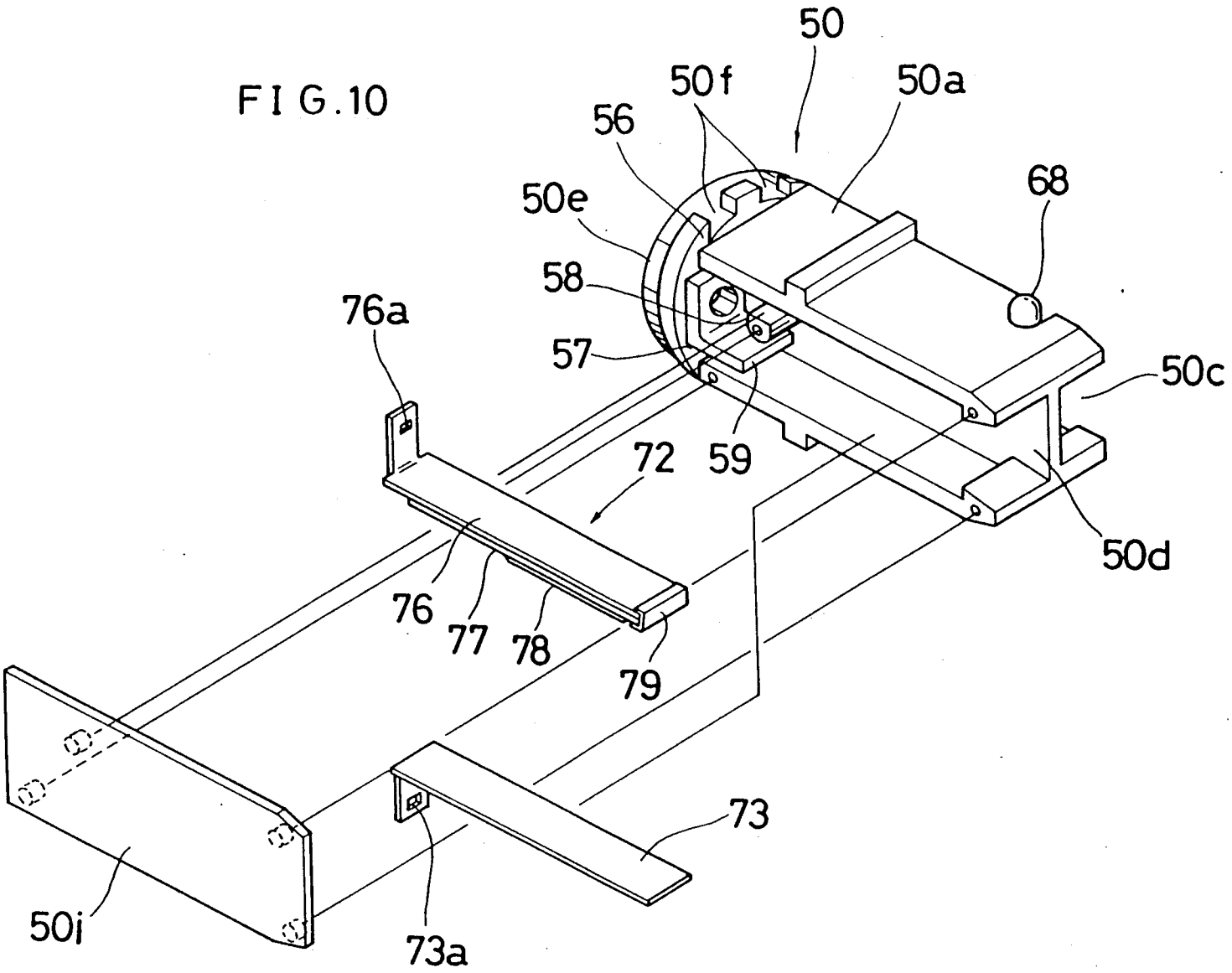

FIG. 10 shows the fitting method of the constructing parts of the variable resistor device 70 to the projecting portion 50*a*. The recesses 56 and 57 are respectively made at both the upper and the lower side of the boundary zone of the projecting portion 50*a* and the mouth metal 57 and bosses are disposed at a predetermined distance along the upper side of the extending portion 50. A bent flat surface resistor 72 is inserted among in the recess 56, above the boss 58, and below the extending portion 50*a*. The bent end portion of the metal conductor 76 is located at the front of the mouth metal 57 and the hole 76*a* thereof is aligned with the ditch 50*f* of the mouth metal 50*e*. The ditch 57 is built in the at the lower side of the extending portion 50*a* by the integrally formed extending portion, and the earth conductor 73 is pressed therein. After this assembly, the cap 50*i* is fitted to cover the side portion of the space 50*d*.

The cap 50*i* is fitted by inserting the integrally built bosses on the inside of the cap into the fitting holes (unnumbered provided at both the upper and the lower sides of the extending portion 50*a* and the boss 58 in the same manner as the cap 50*h* described above.

Figure 11:
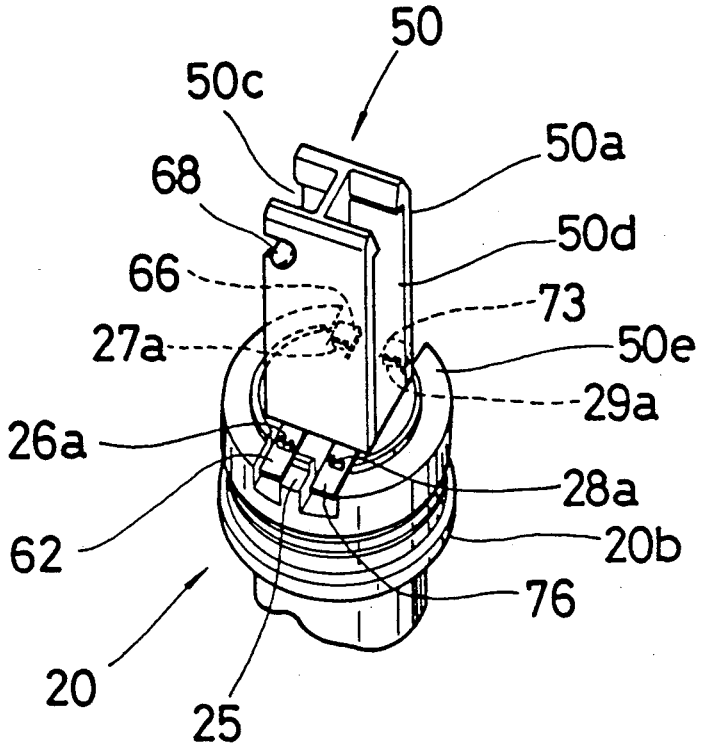
Figure 12:
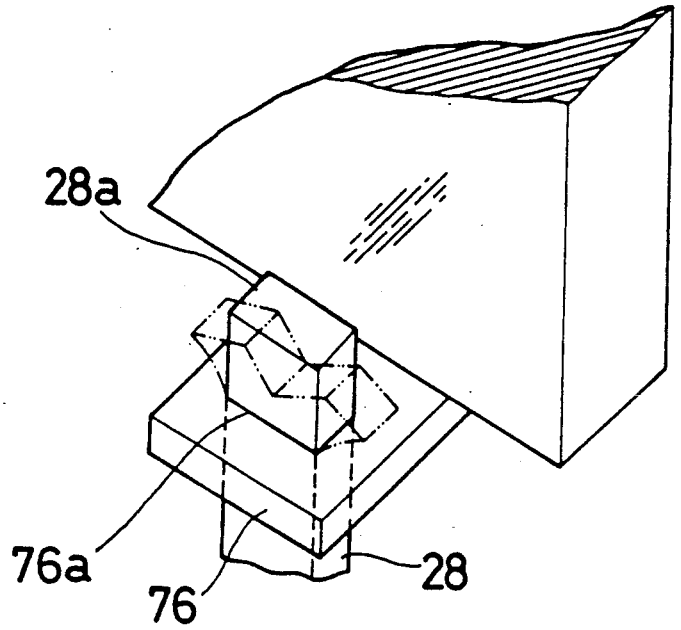

In FIG. 7 numeral 50*j* is an opening to provide communication between the space 50*d* and the space 22*b* of the coupler 20. FIG. 11 shows the sub-assembly of the unmoved body 50 and the coupler 20. As shown in FIG. 12 the unmoved body 50, to which the fuel pump switch 60 and the variable resistor device 70 are assembled, is installed with the coupler 20 such the the end portions 26*a* and 29*a* are projecting, as shown in FIG. 7 and FIG. 11. The recesses 50*f* and 50*g* are made in the mouth metal 57 which is aligned with the holes 62*a*, 68*d*, 73*a* and 76*a* at each conductor end portion, and each extending end 26*a* to 29*a* is clamped by passing through the corresponding holes. As the connecting portion between the terminal 28 and the metal conductor 76 is shown in FIG. 12, after the terminal 28 is passed through the hole 76*a* of the metal conductor 76, the tip end portion of the terminal 28 is cut to open to both sides by the press apparatus as shown in phantom outline and it can fix the coupler 20 with the unmoved body 50 and establish the conductive connection between each terminal at the same time. Prior to the integral assembly of the coupler 20 and the unmoved body 50, the construction parts of the pressure cancel device 80, discussed in the following, are housed the space 22*b* of the coupler.

As shown in FIG. 3, the pressure cancel device 80 includes a bellows 81 made of rubber or a suitable plastic, which is housed within the space 22*b*, and the atmospheric opening 23. The bellows 81 has an opening at one end and a thick ring portion 82 into the inner circumference of which a ring 83 made of hard plastic is inserted. Prior to housing the bellows 81 into the space 22*b*, the outer diameter of the thick ring portion 82 with the inserted ring 83 is larger than the inner diameter of the space 22*b*. The bellows 81 is inserted into the space 22*b* so that thick ring portion 82 is fastened with the extending portion 22 and the ring 83 is fastened with the separating wall 22*a* of the coupler 20. The bellows 81 can seal the space 22*b* against the atmospheric opening 23. The top portion 84 of the bellows 81 is covered by the mouth metal 57 installed at the open portion of the space 22*b*. The space 22*b* communicates with the inner space of the cylindrical portion 16 through the passage 50*j* so that the increase of the inner pressure by the movement of the slider 40 can be cancelled by the pressure cancel device 80. The pressure cancel device 80 in the present embodiment communicates with the atmosphere via atmospheric opening 23, which can be built as a side hole communicating with the inner of the bellows 81 directly in the extending portion 22 for the space 22*b*. In case that the cancelling air volume is comparatively small, a diaphragm can be used. In case of employing such a film to allow only air to pass and to stop liquid from passing, it can make the pressure equalize together with the prevention of water invasion. A pipe element to communicate with the cylindrical portion 16 is provided at the outside and has an open end which is directed downwardly when mounting it on the vehicle body so that it can make the pressure cancel and prevent water invasion.

A return spring device 90 includes a return spring 91 in the resistor side with a comparatively large spring rate, a ring 92 for the spring receiver, and a return spring 93 in the switch side with a comparatively small spring rate. These elements are provided outside the circumference of the slider 40 and outside of the extending portion 50*a*. The return spring 91 in the resistor side is mounted between the flange 41 and the ring 92 for the spring receiver and the return spring 93 in the switch side in mounted between the ring 92 for the spring receiver and the spring receiving portion 25.

Operation of the present embodiment will be described in the following. In FIG. 3 which shows the situation prior to the operation of the fuel pump switch 60 and of the variable resistor device 70, an internal combustion engine (not shown in the drawing) starts and pressurized oil is supplied to the oil passage 13. Then the diaphragm 30 is pushed toward the right in the drawing and the slider 40 is pushed at the same time. The return spring 91 in the resistor side with the comparatively large spring rate is not compressed and the slider 40 moves to the right direction in the drawing by compressing only the return spring 93 in the switch side, the return spring 90 having a comparatively small spring rate. A tapered portion 47 then engages the pin element 68 and pushes the pin element 68 downwardly. The upper end portion 67*a* of the swung plate is swing in a counterclocwase direction since a fulcrum is formed at the lower end portion 67*b*, and the movable contact plate 64 is pulled down against the reverse spring 65. When the movable contact plate 64 goes down lower than the fulcrum of the reverse spring 65, the reverse spring 65 reverses its biasing direction and pushes down the movable contact plate 64, with the result that the movable contact 63 can contact the fixed contact 61 to make the switch "ON" and in order to actuate the fuel pump. As the fuel pump switch 60 is actuated by closing of the switch, by meeting of the contacts 61 and 63 it can maintain an "ON" or "OFF" condition with fewer adverse effects caused by pulsation of oil pressure in the oil supplied to the oil pressure passage 13.

Figure 13:
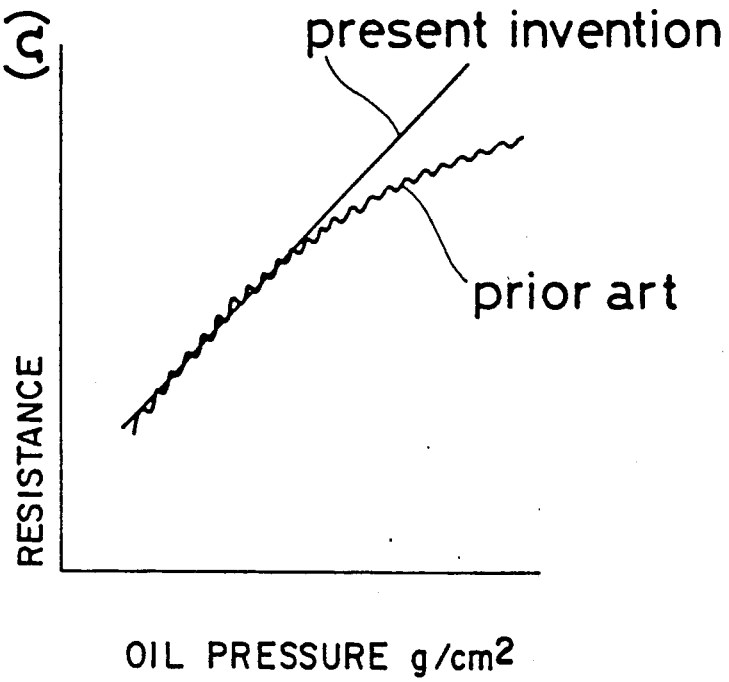

As there is provided the jet 14 in the oil pressure passage 13, effects of the oil pulsation are reduced. In a second stage of operation increasing the supplied oil pressure further at the oil pressure passage 13, the slider 40 advances further to the right in FIG. 3 to begin the compression of the return spring 91 on the resistor side. The wire brushes 75 built in the tip end portion of the slide contact plate 71 slidably moves along the ground conductor 73 and the flat resistor 72 together with the slider 40 to alter the electrical resistance of the circuit with the result that the oil level corresponding to the electrical resistance can be indicated by an oil meter (not shown in the drawings) which is connected to the circuit. As the flat resistor 72 is employed in the present embodiment, the resistance change can be smooth, as shown in FIG. 13. Further, as the wire brush 75 can slide on the flat resistor 72, it is easy for some of the wires to always be in contact with the flat resistor 72 regardless of the inclination of the slide contact plate 71. When the slider 40 moves further to the right, the pressure in the cylinder portion 16 increases to press the bellows 81, causing air to flow through the opening 50*j* in the mouth metal 57, as shown in FIG. 7. Air within the bellows 81 escapes through the atmospheric opening 23 to the coupler side 21 to equalize the pressure within the space 44 this avoids an increase in resistance to movement of the slider 40 to make the linearity for the relationship between the electrical resistance change and the movement of the slider 40, as shown in FIG. 13. Since the bellows 81 tightly seals the atmospheric opening 23 from the exterior of the cylindrical portion 16, the assembly is water and steam proof. Since the unmoved body 50 is fixed to the coupler 20 by clamping, the assembly work can be easy and speedy. As the fuel pump switch 60 and the variable resistor device 70 are assembled to both sides of the extending portion 50*a*, it is possible to make the assembly operation automatic.

Figure 14:
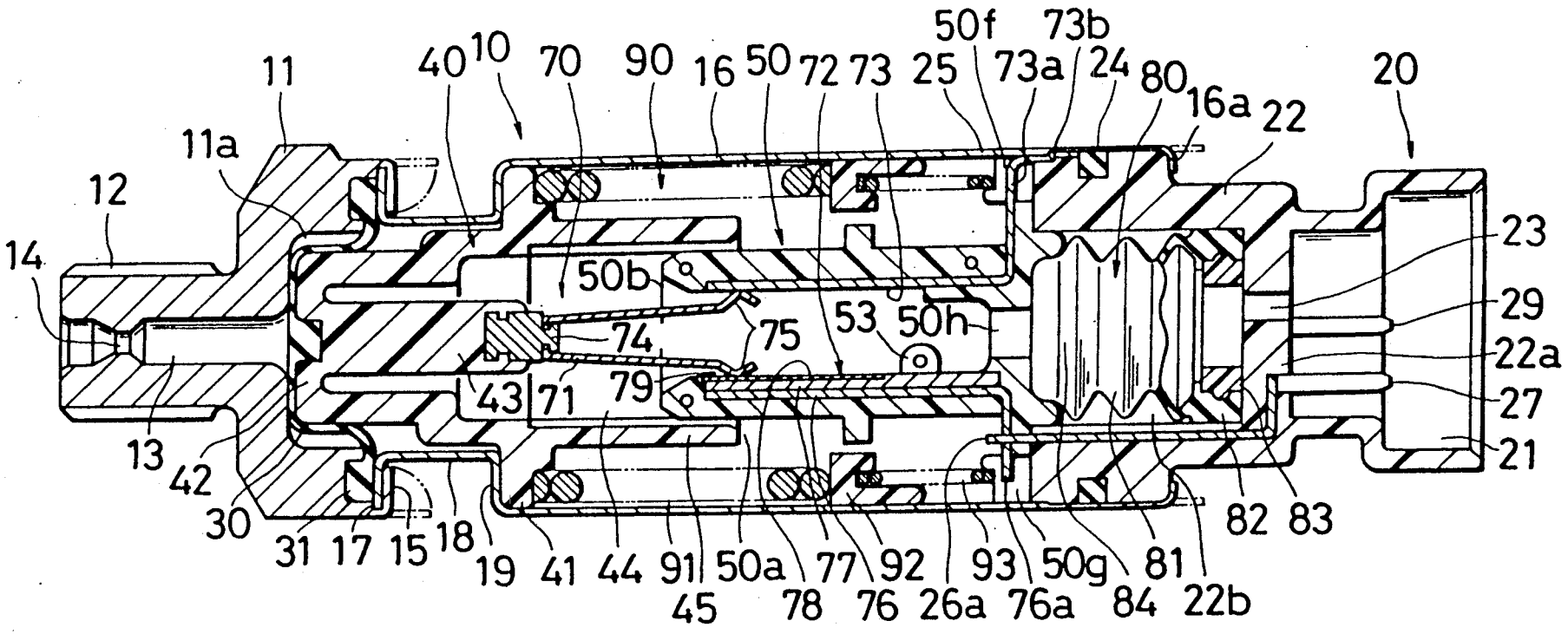
FIG. 14 to FIG. 16 show a second preferred embodiment.
Figure 15:
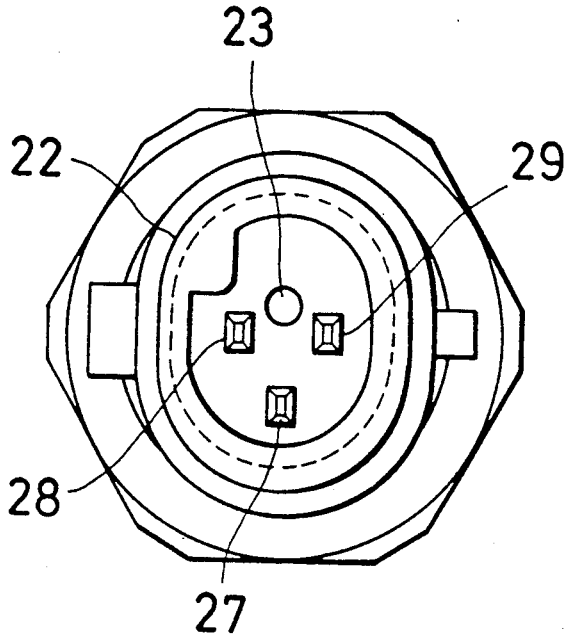
Figure 16:
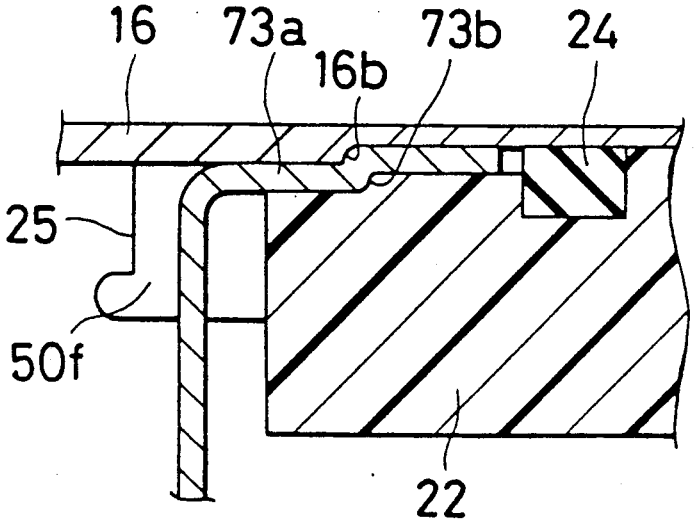

FIG. 14 to FIG. 16 show a second preferred embodiment. The feature of the present embodiment is to employ the body ground construction for the earth conductor 73. Except the above, other construction is substantially same as one in FIG. 14. The earth conductor 73 is made of a suitable metal and one end portion thereof is bent to the radius direction to build the extending portion 73*a* by bending it again to the horizontal direction. The extending portion 73*a* is put on the outer circumference of the extending portion 22 and extends on the outer circumference of the extending portion 22 to the coupler side. It makes the bending portion 73 following the step portion 16*b* of the cylindrical portion 16 shown in FIG. 16 and can conduct with the cylindrical portion 16. To build the bending portion 73*b* is done at the same time when the coupler extending portion 22 is inserted into the cylindrical portion 16. The extending portion 73*a* is straightly extending to put on the outer circumference of the coupler extending portion 22. After the unmoved body 50 is sub-assembled to the extending portion 22, it is inserted into the end portion of the cylidnrical portion 16 and the extending portion 73*a* is tightly sticked along the inner surface of the cylindrical portion 16. The end portion of the cylindrical portion is integrated with the coupler 20 by the clamping portion 16*a*. The end portion of the metal conductor 76 of the flat resistor 72 is connected to the terminal 29 as shown in FIG. 14, resulting in the construction of the electrical circuit through the terminal 29-the flat resistor 72-the slide contact plate 71-the earth conductor 73-the cylindrical portion 16.

Figure 17:
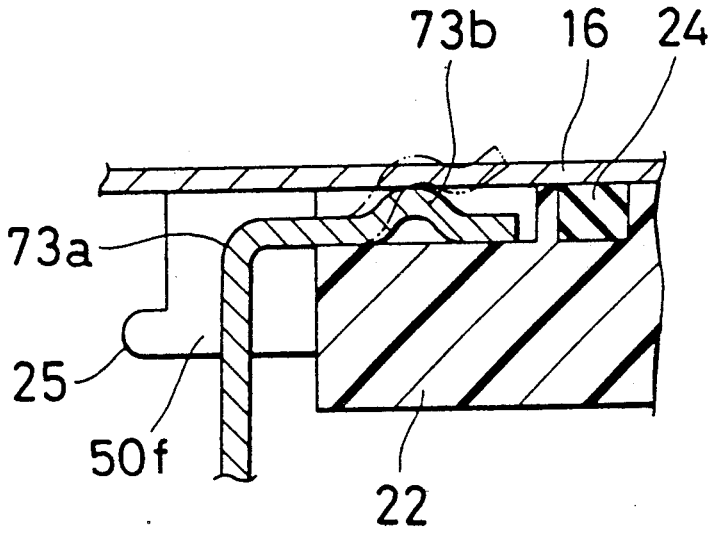
FIG. 17 is a partially enlarged vertical view of a third preferred embodiment.

Under such a condition that the wire brush contacts with the earth conductor 73 and the resistor layer 78, the resistance alters by the movement of the movable body 40 and the slide contact plate 71. FIG. 17 shows another body earth construction. There is built the resilient bending portion 73*b* in one extending portion 73*a* of the earth conductor 73. As it has the resilient modification during the time when being inserted into the cylindrical portion 16, it can make the electrical contact of the body earth by the spring action thereto. When the extending portion 22 is inserted into the cylindrical portion 16, the bending portion 73*b* has the resilient modification between the cylindrical portion 16 and the extending portion 22 because the outer diameter of the extending portion 22 is comparatively smaller than the inner diameter of the cylindarical portion 16.

Figure 18:
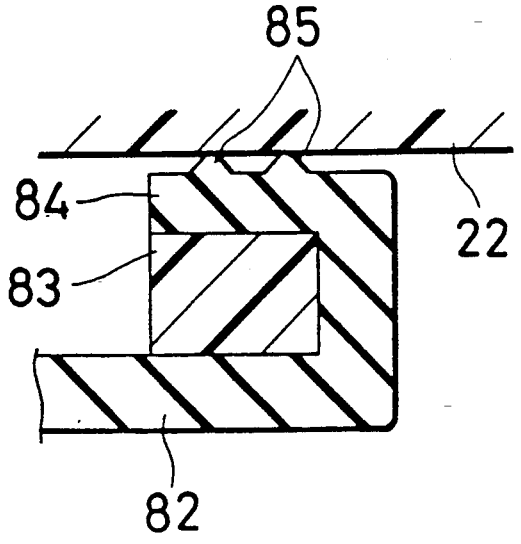
FIG. 18 and FIG. 19 show a fourth preferred embodimant.
Figure 19:
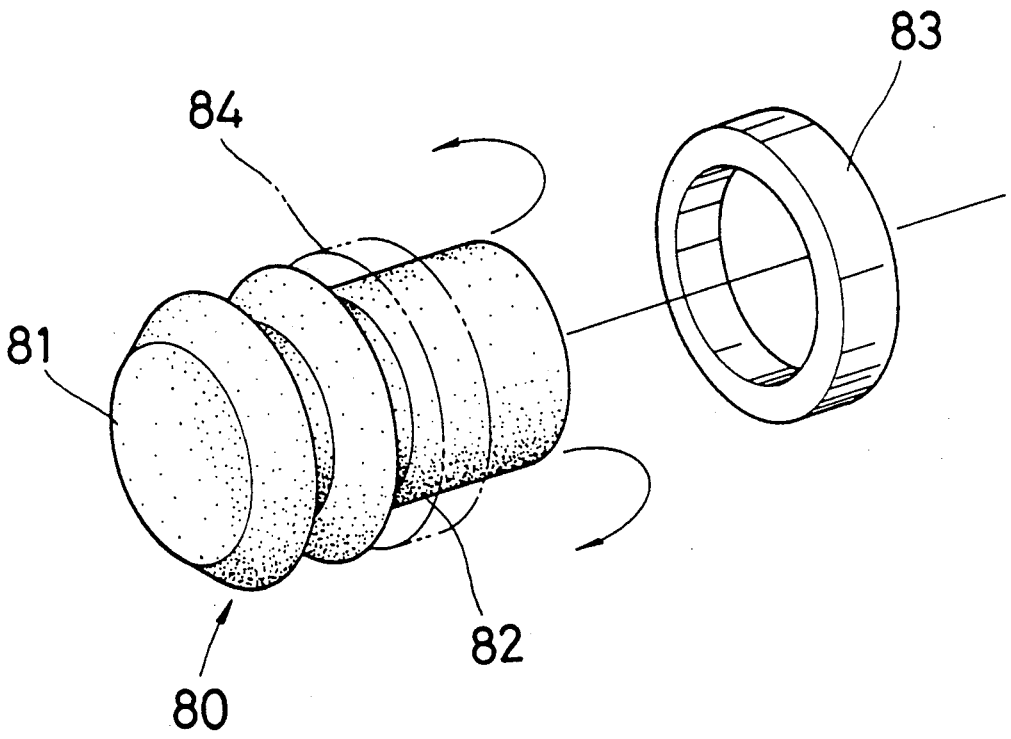

FIG. 18 and FIG. 19 show another embodiment of the pressure cancel device. The bellows 81 made of rubber and reasonable plastic has a integrally made cylinder 82 as the long neck figure. The open end portion thereof has a flap portion 84 and the lip 85 is projected outwardly on the outer circumference thereof. A ring 83 (made of hard plastic) is inserted to the inner side of the flap portion 84. FIG. 19 shows how to install the ring 83 to the bellows 81. Before flapping the flap portion 84, the tip end portion of the cylinder 82 is passed to the ring 83 and thereafter the flap portion is made, resulting in that the ring 83 is installed to the circumference of the cylindrical portion 82. The flap portion 84 of the bellows 81 is inserted into the space 22*b* through the open side of the extending portion 22. The open end portion of the bellow 81 covers the atmospheric opening 23 and the lip 85 of the flap portion 84 is tightly engaged with the inner surface of the extending portion 22 which make seals the space 22*b*, since the inner side of the cylindrical portion 16 is totally sealed by the lip 85 of the bellows 81.

Figure 20:
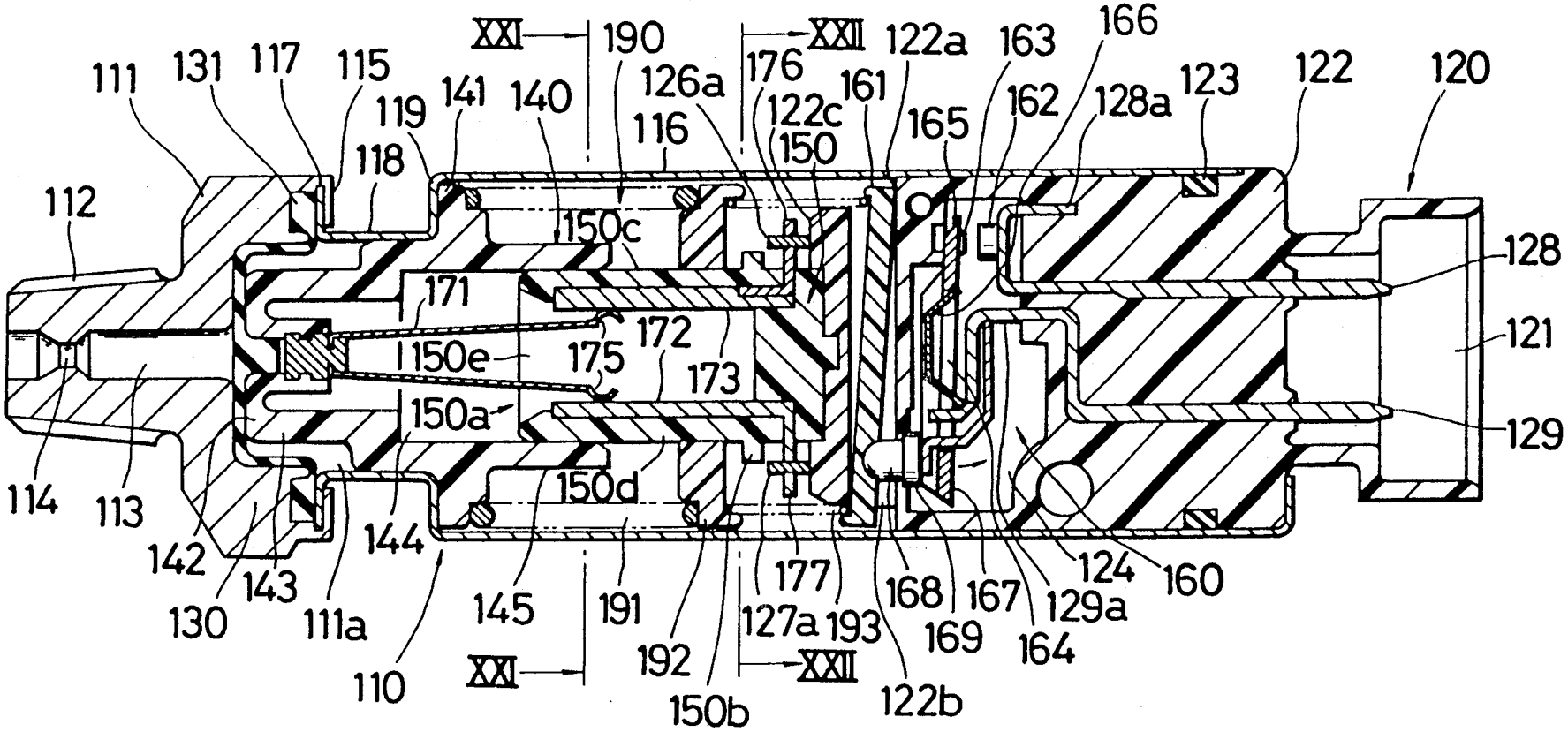
FIG. 20 to FIG. 24 is a fifth preferred embodiment.
Figure 21:
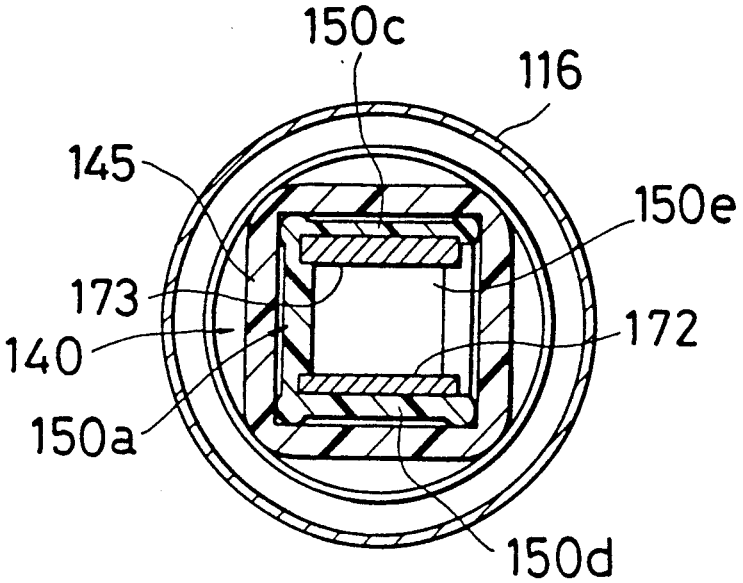
Figure 22:
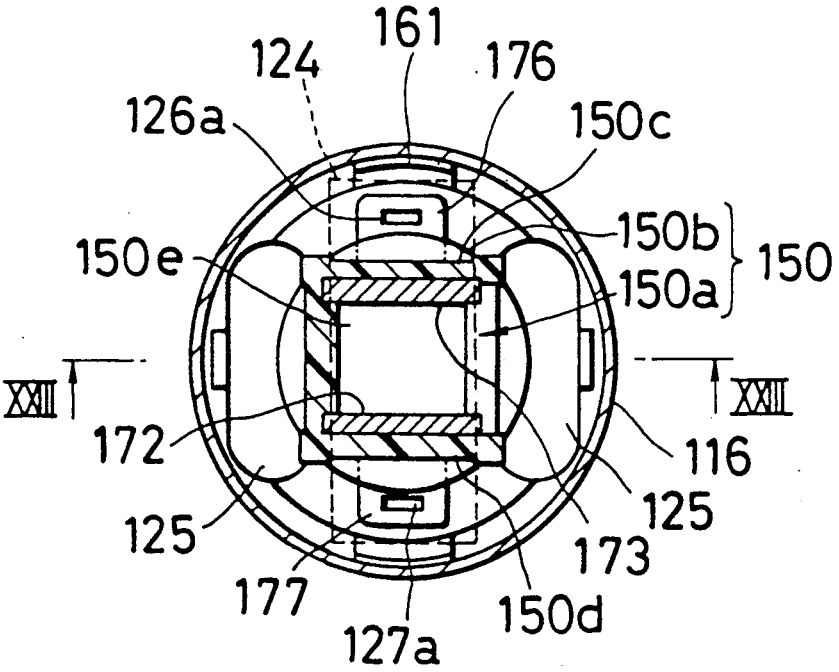
Figure 23:
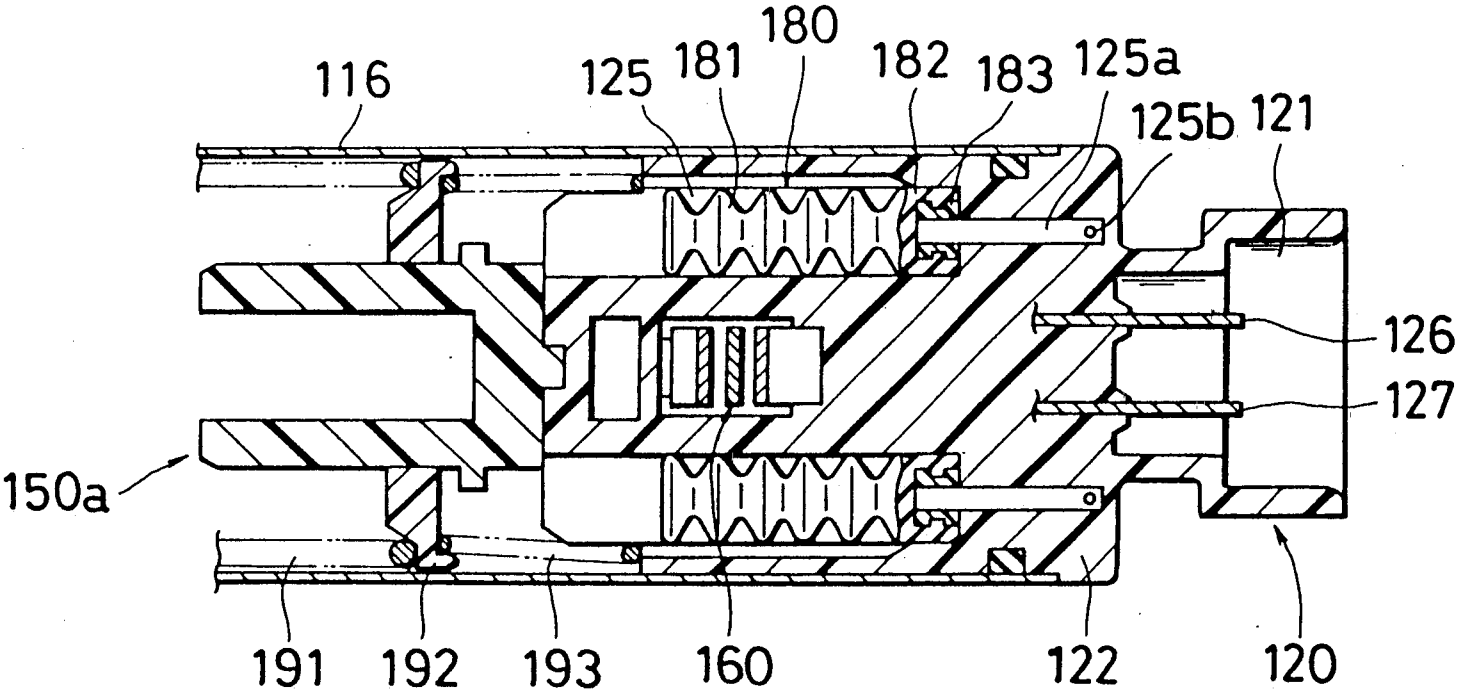
Figure 24:
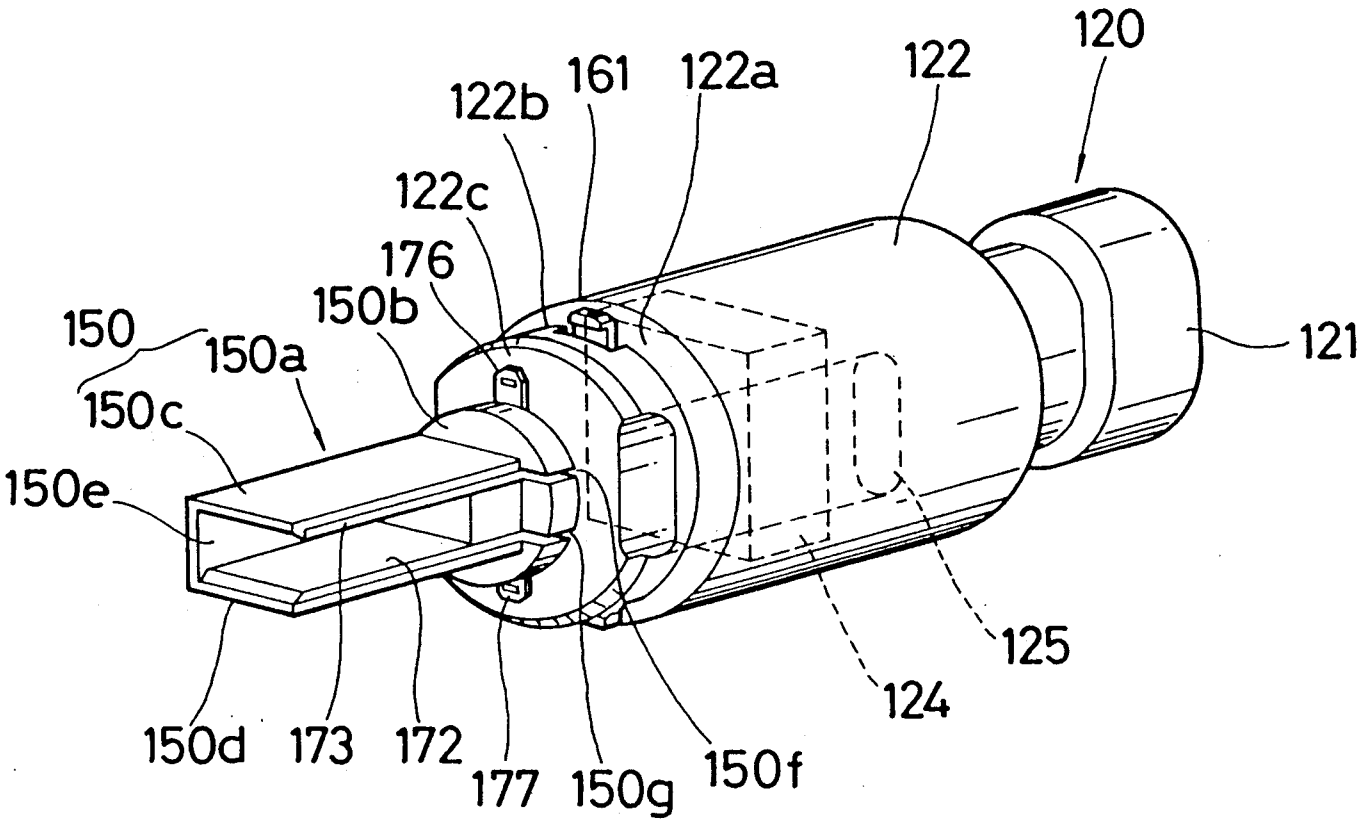
Figure 25:
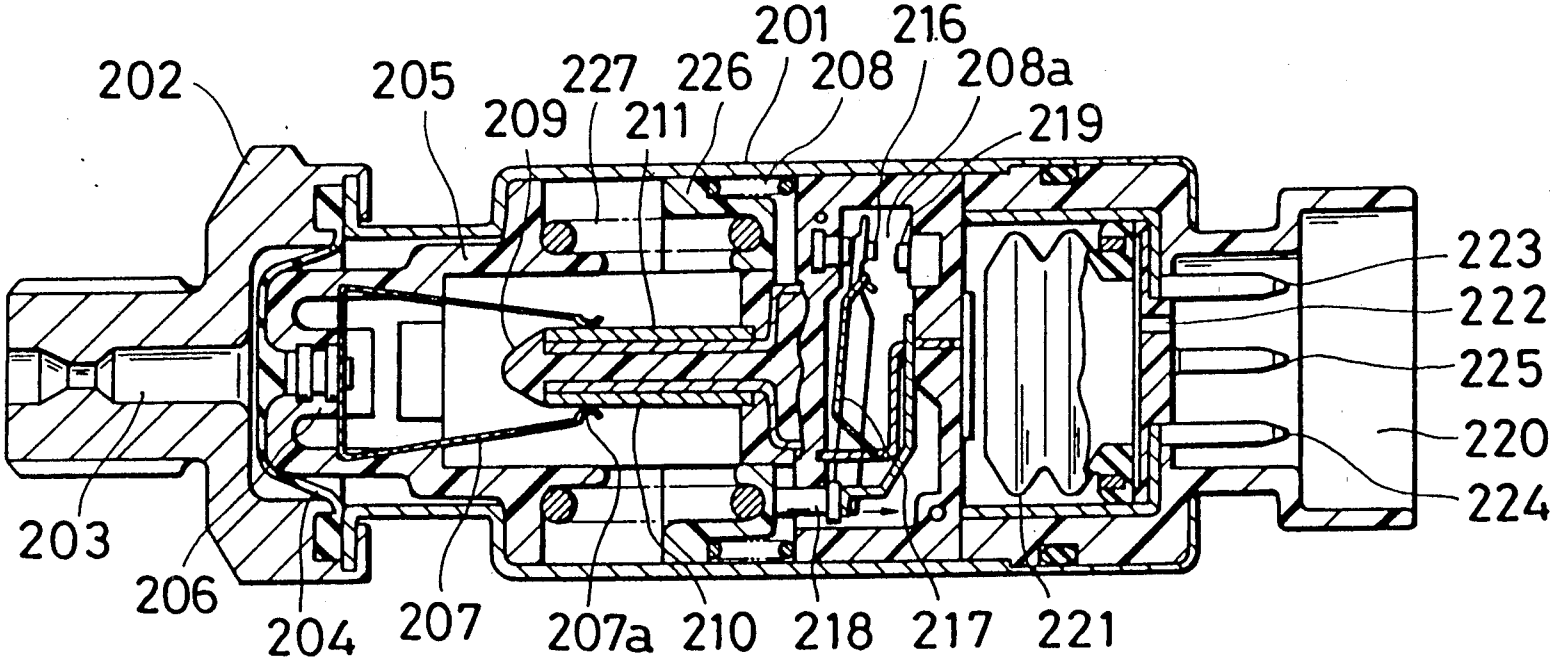
FIG. 25 to FIG. 32 show a sixth preferred embodiment.

FIG. 20 to FIG. 24 shows another preferred embodiment in which a fuel pump switch is disposed in series to a variable resistor device and a presure cancel device is disposed in parallel thereto. As shown in FIG. 20 showing the vertical sectional view of the apparatus, in FIG. 21 and FIG. 22 showing the transverse sectional view thereof, and the FIG. 23 showing a partially sectional view shifted at 90 degrees from FIG. 20, a coupler 120 is installed to one end of a case 110 which consists of a base 111 connecting to the pressurized oil circuit of the oil pump and a substantial cylindrical portion 116. There are housed a diaphragm 130, a slider 140, an unmoved body 150, a pressure cancel device 180 refering to FIG. 23 and a return spring device 190 therein. A fuel pump switch 160 is provided at the portion next to the unmoved body 150 of the coupler 120 and a variable resistor device is provided in the unmoved body 150. The coupler 120 and the unmoved body 150 build a integral sub-assembly as the outside view thereof being shown in FIG. 24. The mouth metal 111 has the fitting screw portion 112 formed at the outer circumference thereof, the oil pressure passage 113 at the center thereof and the jet portion 114 which squeeze a part of the oil pressure passage 113. The clamping portion 115 is made at the connecting portion between the mouth metal 111 and the cylindrical portion 116 and is overlapped with the outward directed flange portion 117 made at one end portion of the cylindrical portion 116, resulting in that both portions are integrally attached to each other. In the drawing numeral 118 is the avoiding recess portion of turning over the clamping portion 115 and numeral 119 is a step portion opposing against the flange portion 117. The coupler portion 121 which can house the connecting portion of the terminal and the extending portion 122 extending to the inner direction of the cylindrical portion 116. The circumference of the extending portion 122 is inserted to the cylindrical portion 116 and tightly jointed each other through the sealing ring 123. As shown in FIG. 22, the space 124 extending to the radius direction is provided at the central portion of the projecting portion 122 to house the fuel pump switch 160. A couple of spaces 125 are respectively provided at both side portions of the space 124 to house the pressure cancel device 180. The space 124 has the long portion to the radius direction and the space 125 has the long portion to the longitudinal direction. The communicating hole 125*a* is connected to the space 125, which is extending to the coupler portion 121. A connecting hole 125*b* is built in vertical to the communicating hole 125*a* at one end thereof, which communicates to the atmosphere. Four terminals 126 to 129 are houses within the coupler portion 121. The middle portions of the terminals 126 to 129 are integrally laid in the extending portion 122. The terminals 126 and 127 are provided for the variable resistor device 170 and the terminals 128 and 129 are provided for the fuel pump switch 160. The diaphragm 130 is housed within the recess space 111*a* of the mouth metal 111 to cover the inside mouth portion of the oil pressure passage 113. The comparatively wide and annular expanded portion 131 is integrally formed at the circumference portion thereof and it is put between the end surface of the mouth metal and the flange 117 to make the liquid tight seal. The slider 140 is housed within the diaphragm 130. The flange 141 is proveided at the outer circumference of the slider 140. The boss 143 is integrally built in the bottom portion 142 thereof. The square cylindrical wall portion 145 is provided to make the sliding space 144, which is extending from the frange 141 to the right direction in the drawing as shown in FIG. 21. The unmoved body 150 has the conductive fitting portion 150*a* with the square cylinder figure and the base portion 150*b* with the substantial circle figure.

The tipend portion of the conductive fitting portion 150*a* is capable of inserting into the wall portion 145. The flat resistor 172 and the earth conductor 173 are respectively mounted in each inside of the upper side 150*c* and the lower side 150*d* of the conductive fitting portion 150*a*. The square hole 150*e* is formed in the center portion of the unmoved body 150. There are provided the ditches 150*f* and 150*g* in the base portion 150*b* corresponding to the upper side 150*c* and the lower side 150*d*, to which the flat resistor 172 and the earth conductor 173 can be inserted from the side direction thereof. Each terminal of the flat resistor 172 and the earth conductor 173 is connected to each terminal 128 and 129 through the connecting plates 176 and 177 which is bent with Letter "L" figure and is extending to the radius direction. A fork typed slide contacting plate 171 is installed in the boss 143. A wire brush 175 is provided at the free end of the slide contacting plate 171 and sliders on the flat resistor 172 and the earth conductor 173 alter the resistance. The variable resistor device consists of the flat resistor 172, the earth conductor 173 and the slide contacting plate 171. The fuel pump switch 160 consists of the lower 161 passing through the side hole 122*b* which is formed in the end portion 122*a* of the extending portion 122 to the radius direction, the fixed contact 162 provided in the supporting portion 128*a* of the one end portion of the terminal 128, the movable contact plate 165 with the frame shape having the movable contact 163 at one end thereof and the long hole 164, the supporting portion 129*a*, which is one end portion movable contact plate 165 and the reverse spring 166, the swing plate 167 supported by the fulcurum of one end of the supporting portion 129*a*, and the press element 168 which moves one end of the swing plate 167 up and down.

One end of the reverse spring 166 is connected to one end of the long hole 164 at the slide of the movable contact 163 and other end thereof is connected to the hole formed in the upper stage portion of the supporting portion 129*a*. The upper end portion of the swing plate 167 pass through the long hole 164 upwardly and is bent to the horizontal direction to contact with the flange portion 169 of the press element 168. The actuating direction of the press element 168 is identical with the moving direction of the slider 140.

The pressure cancel device 180 consists of the bellows 181 made of rubber or the reasonable plastic housed in the space 125, the communicating hole 125*a* and the atmospheric open 125*b* as shown in FIG. 23. One end of the bellows 181 has the open and the thick portion 182 and the ring 183 made of the hard plastic and so on is inserted thereof. The bellows 181 is inserted into the space 125 and the thick portion 182 can stick with the inner surface of the extending portion 122 surrounding the space 125, resulting in the tight seal of the inner portion thereof from the atmospheric open 125*b*. As the space 125 communicate with the cylinder portion 116 in the slider 140 side, the increase of the inner pressure generated by the slider 140 movement can be cancelled by the pressure cancell device 180. A return spring device 190 consists of a return spring 191 in the resistor side with a comparatively large spring rate, a return spring 193 in the switch side with a comparatively small spring rate, and a ring 192 for receiving the spring.

They are provided around the slider 140 and the unmoved body 150. The return spring 191 in the resistor side is mounted between the flange 141 and the ring 192 for receiving the spring. The return spring 193 in the switch side is mounted between the ring 192 and the lower 161. Under no lead condition to the return spring 193 in the switch side, it is conpressed to some extent as one end of the lever is lifted by the press element 168 because of elasticity of the reverse spring 166.

Function of the present embodiment will be described in the following. After the engine not shown in the drawing starts, the return spring 193 in the switch side with a comparatively small spring rate is compressed to reverse the bias direction of the reverse spring 166 and then the movable contact 163 consists with the fixed contact 162. It makes the fuel pump switch 160 switch on to actuate the fuel pump not shown in the drawing. As the operating direction of the press element 168 is identical with the moving direction of the slider 140, the press element 168 can be vertically contact with the lever 161 which received the force of the return spring 193 in the switch side so that it can improve the hysterisis loss from the on-off action of the switch and the operation acuracy. The slider 140 moved further to the right direction, the inner pressure in the cylinder portion 116 increases. Air within the bellows 181 runs from the atmospheric open 125*b* to the outside to cancel the pressure increase.

Figure 26:
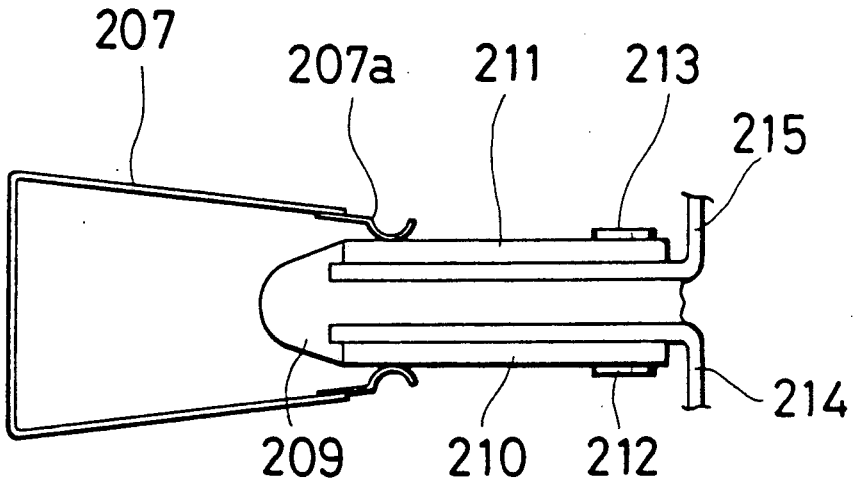

FIG. 25 to FIG. 32 show another preferred embodiment having the altered construction of the flat resistor. An oil passage 203 is made in a mouth metal 202 installed at one end of a case 201 made of metal with the cylinder figure and a diaphragm 204 is provided at the outlet of the case 201. A slider 205 is provided in the space divided by the diaphragm 204 within the case 201. The slider 205 is the cylindrical figure with the bottom and the central portion of a slide contact plate 207, which has the shape " " in the side view and the narrow width of the free ends, is installed on a boss portion 206 integrally formed with the bottom. The free end portion of the slide contact plate 207 makes a wire brush 207*a*. An unmoved body 208 made of plastic is housed in the central portion of the case 201. A extending portion 209 extending to the boss portion 206 direction is formed in the central portion of the unmoved body 208. A flat resistor 201 and a flat resistor 211 are supported on both the upper and the lower surfaces of the extending portion 209 to slidably contact with the wire brush 207*a*. The flat resistor 210 and 211 are electrically connected to terminals 214 and 215 by means of metal clampers 212 and 213 as shown in FIG. 26. FIG. 26 shows the side view to describe the relationship among the slide contact plate 207, the flat resistor 210 and 211. A space 208*a* is formed to house the fuel pump switch in the opposite portion of the extending portion 209 of the unmoved body 208. The fuel pump switch is a micro type switch and consists of a reverse spring 217 which selectively biases either the open condition or the close one of the movable contact 216, a pin 218 which smoothly comes and goes from the side portion of the unmoved body 208 to the slider 205 in order to reverse the reverse spring 217, and the fixed contact 219. When the pin 218 moves to the direction indicated with the arrow, the movable contact 216 connects to the fixed contact 219 by the reverse spring 217. The coupler 220 is installed to the other side of the case 201 and the bellows 221 is provided between the coupler 220 and the unmoved body 208. The inside of the bellows 221 communicates with the atmosphere through the atmospheric open 222 formed in the divided wall portion of the coupler 220 in order to function as the pressure cancel device for the pressure in the case 201. The bellows 221 separated the coupler from the inside of the case 201 to have such a function of water proof device for the fuel pump switch and the variable resistor device in the case 201. The terminals 223 and 224 projecting to the coupler 220 inside electrically connects to the fixed contact 219 and the movable contast 216 and the pair of the terminal 225 electrically connects to the terminals 214 and 215. A couple of the return spring 227 and 228 with the different strength are mounted between the slider 205 and the unmoved body 208 through the retainer 226 with the sectional form Letter "S". The return spring 228 is difinitely weaker than the return spring 227.

Figure 27:
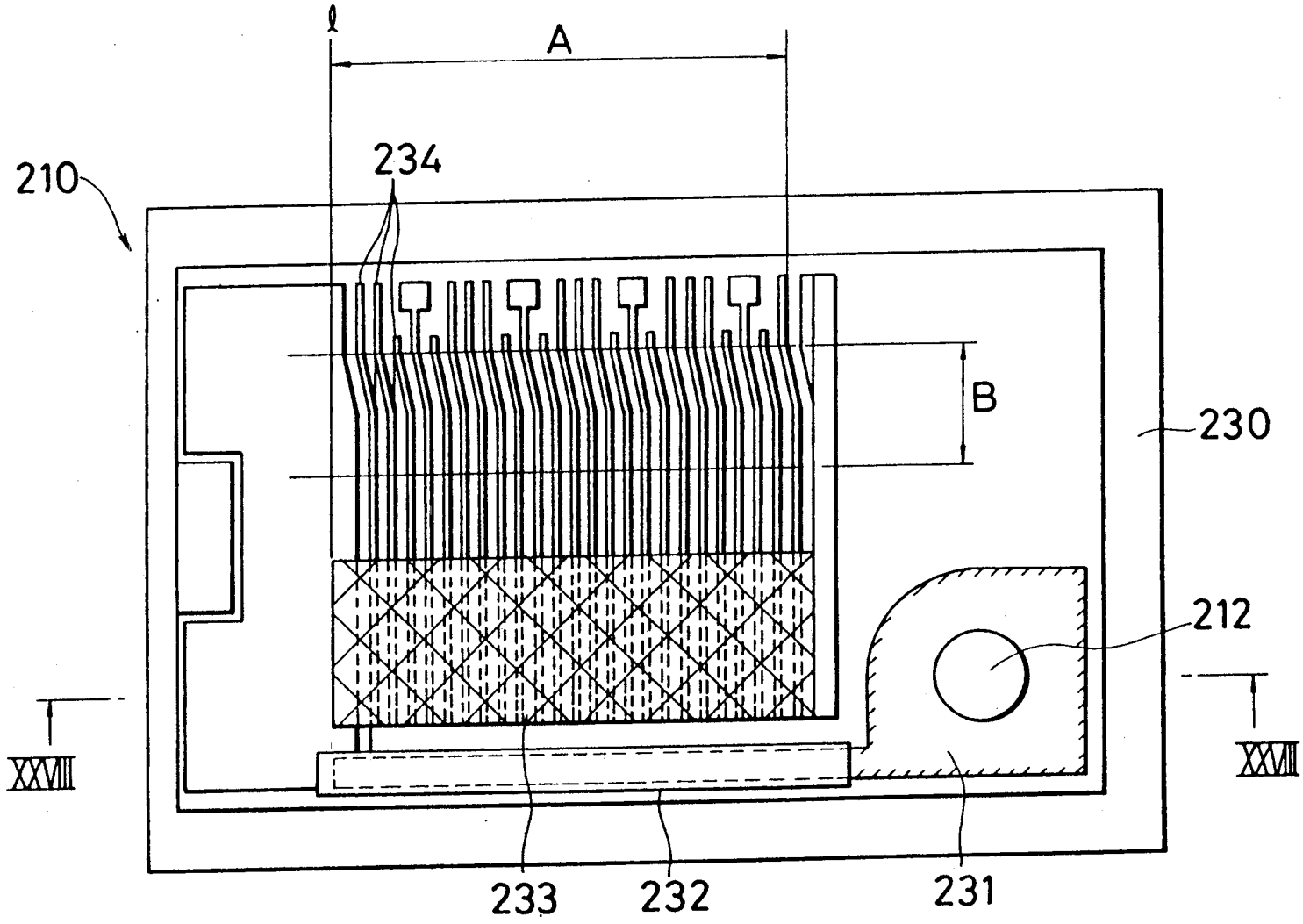
Figure 28:
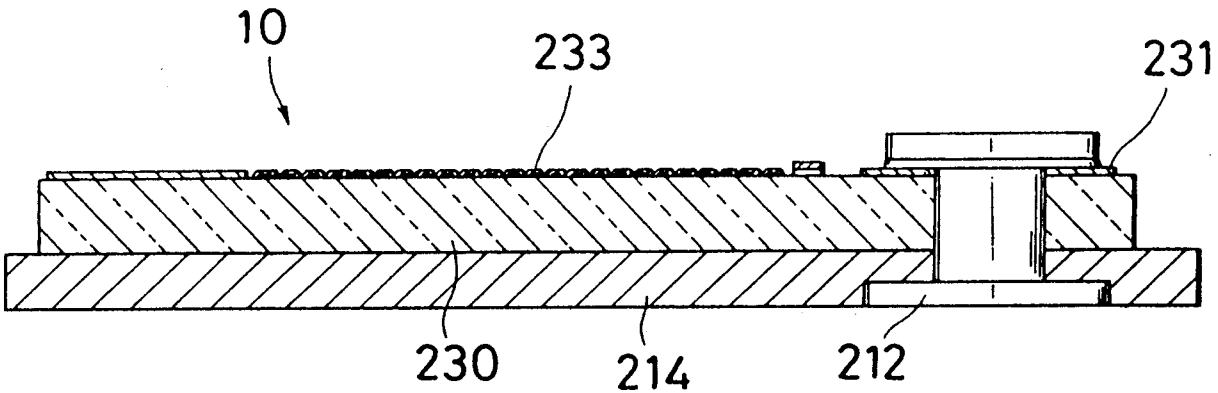
Figure 29:
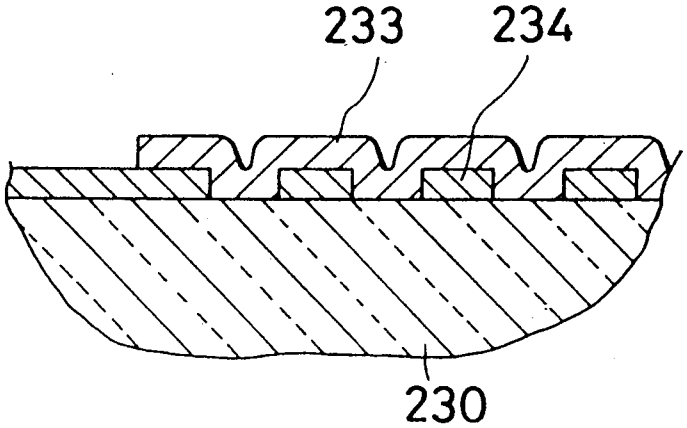

FIG. 27 to FIG. 29 show the detailed construction of the flat resistor 210. There is provided the conductive portion 231 in the flat resistor 210 which is integrated with the terminal 214 by the clamp 212 through the insulating base 230. The conductive portion 231 projects to the other side of the clamp 212 along the long side of the base 230 and the surface thereof is covered with the insulator 232. The other side portion of the conductive portion 231 is connected to the end portion of the resistor 233 built in parallel thereto. The resistor 233 is provided overlapping with the slim band conductor 234 to electrically connect thereto. The band conductor 234 is vertical to the moving direction of the wire brush 209*a* and has a plurality conductors in parallel and apart with the reasonable distance each other printed crossing in the sliding zone which is formed by the moving zone of the wire brush 207*a* indicated with Letter "A" and the contacting width of the wire brush 207*a* indicated with Letter "B". The resistor 233 is provided outside of the sliding zone. The band conductor 234 is exposed in the sliding zone is capable of slide contacting with the wire brush 207*a*. A part of the band conductor 234 is formed slantingly in the contacting width B.

Figure 30:
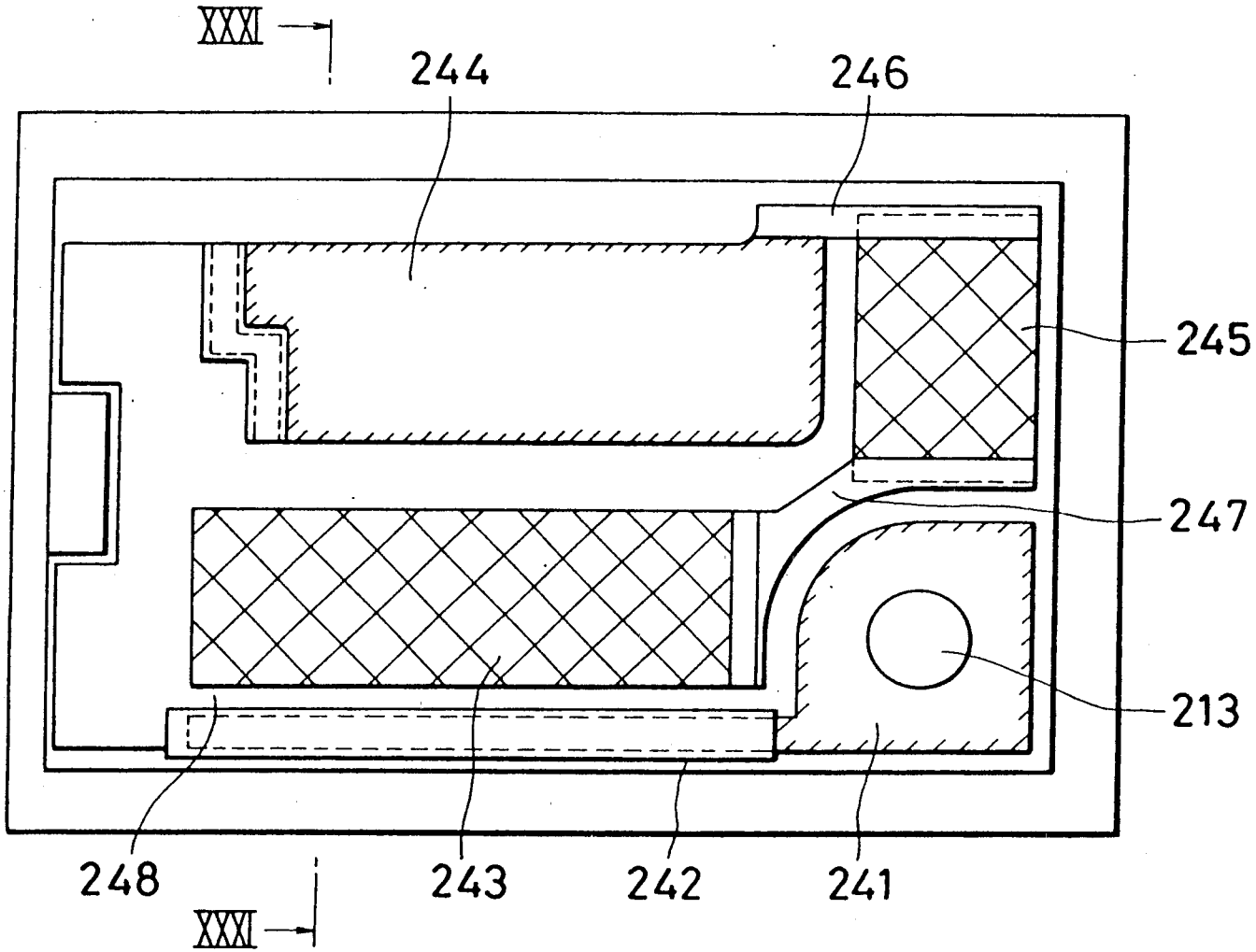
Figure 31:
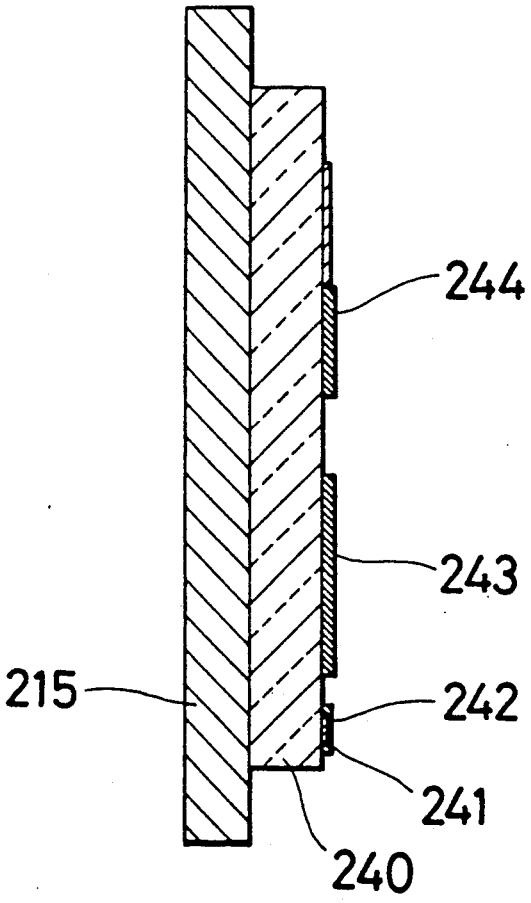
Figure 32:
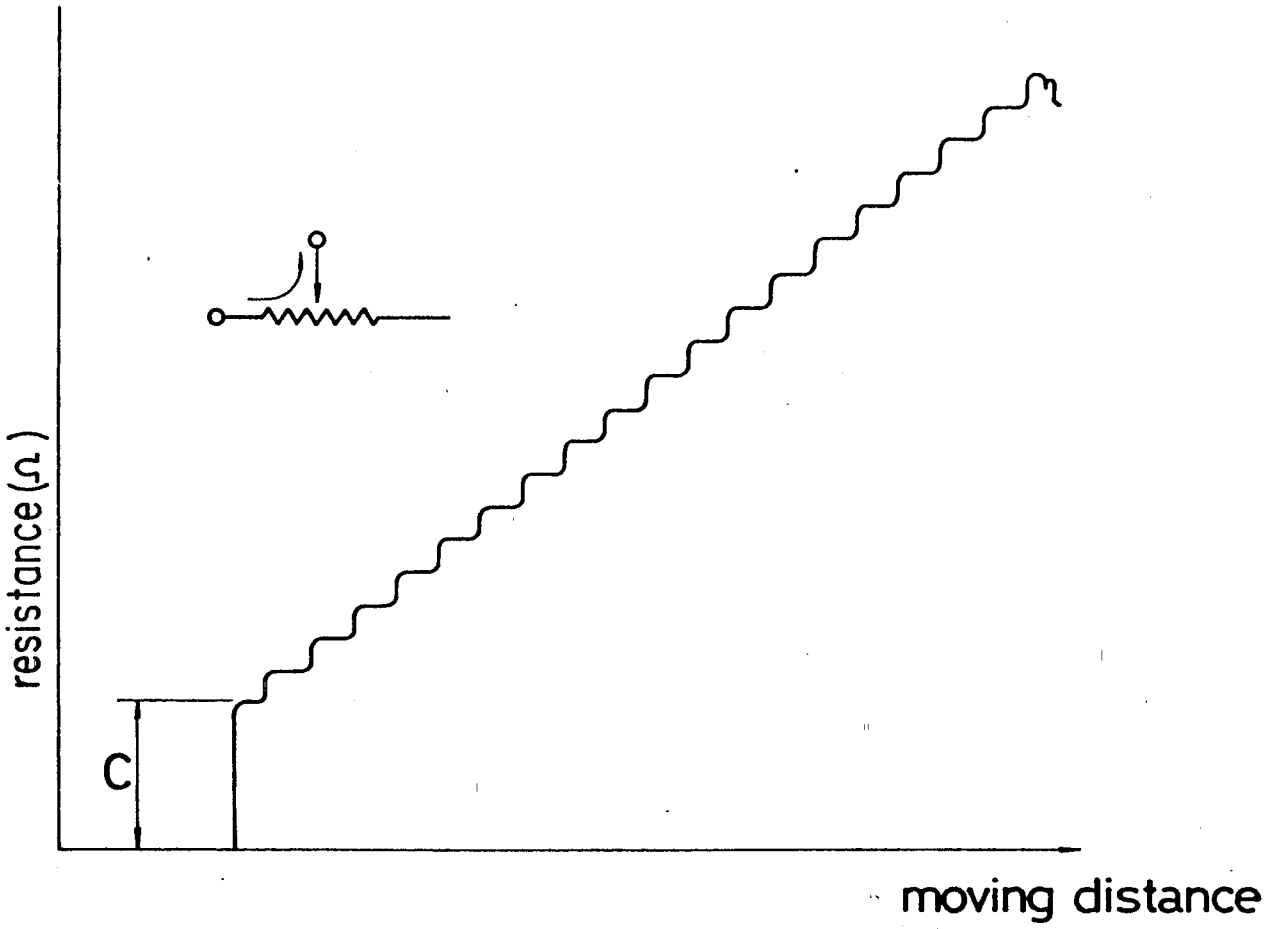

The resistor 233 is made of a comparatively good wear resistance like ceramic metal material and is formed on the almina base ($Al_2O_3$). The band conductor 234 is made of alloy of silver and palasium with a compartively good wear resistance. The earth conductor 211 is constituted by connecting electrically the terminal 215 to the conductor 241 on the insulator base 240 by the clamper 213 as shown in FIGS. 30 and 31. The conductor 241 projects to the other side of the clamp 213 along the long side of the insulator base 240 and the surface thereof is covered with the insulator 242.

The other end of the conductor 241 is connected to the end portion of the fundamental resistor 243 which is in parallel thereto and is formed with a comparatively wide area. The fundamental resistor 243 is made of the same material of the resistor 233. The conductor 244 is provided in the moving zone of the wire brush 207*a* and in parallel to the fundamental resistor 243. Another fundamental difference from the fundamental resistor 243 resistor 245 is provided at the non-contact position with the wire brush 207*a* at the extending position from the conductor 244. The connecting portions 246, 248 and 248 are electrically built respectively between the conductor 244 and the fundamental resistor 245, between the fundamental resistor 245 and 243, and between the fundamental resistor 243 and the conductor 241.

Function of the present embodiment will be described in the following. When the wire brush slides on the flat resistor 210 and 211, an electrical circuit is formed through the terminal 214, the clamp 212, the conductive portion 231, the flat resistor 233, the band conductor 234, the wire brush 207*a*, the slide contact plate 207, the wire brush 207*a*, the conductor 244, the connecting portion 246, the fundamental resistor 245, the connecting portion 247, the fundamental resistor 243, the connecting portion 248, the conductor 241, the clamp 213, the terminal 215.

The slider 295 moving against the return spring 228 in corresponding to the oil pressure supplied from the oil passage 203, the wire brush 207*a* slides on the flat resistor 210 and 211 from the starting line l within the sliding zone in response to the oil pressure. Even if the wire brush 209*a* positions at the middle of the band conductor 234, the wire brush 209*a* is capable of surely contacting with some of the band conductor are incling. As the wire brush 207*a* contacts selectively with each of the band conductor 234, the resistance of the resistor 233 changes in step by corresponding to the wire brush 207*a* movement as the graph shown in FIG. 32. If the pressurized oil supplied from the oil passage 203 makes the oil pressure pulsation, the output of the resistor changed in step without the instant corresponding to the pulsation. There is no alternation with the little by little wave in the oil level indication. As the wire brush 207*a* does not make the direct slide contact with the resistor 233, the fundamental resistor 243 and 245 made of the comparatively poor wear resistance material, it can improve the wear resistance. The fundamental resistors 243 and 245 in the flat resistor 211 side have the contact fundamental resistance even if the wire brush 207*a* positions at the start line l as shown with Letter "C" in FIG. 32.

Figure 33:
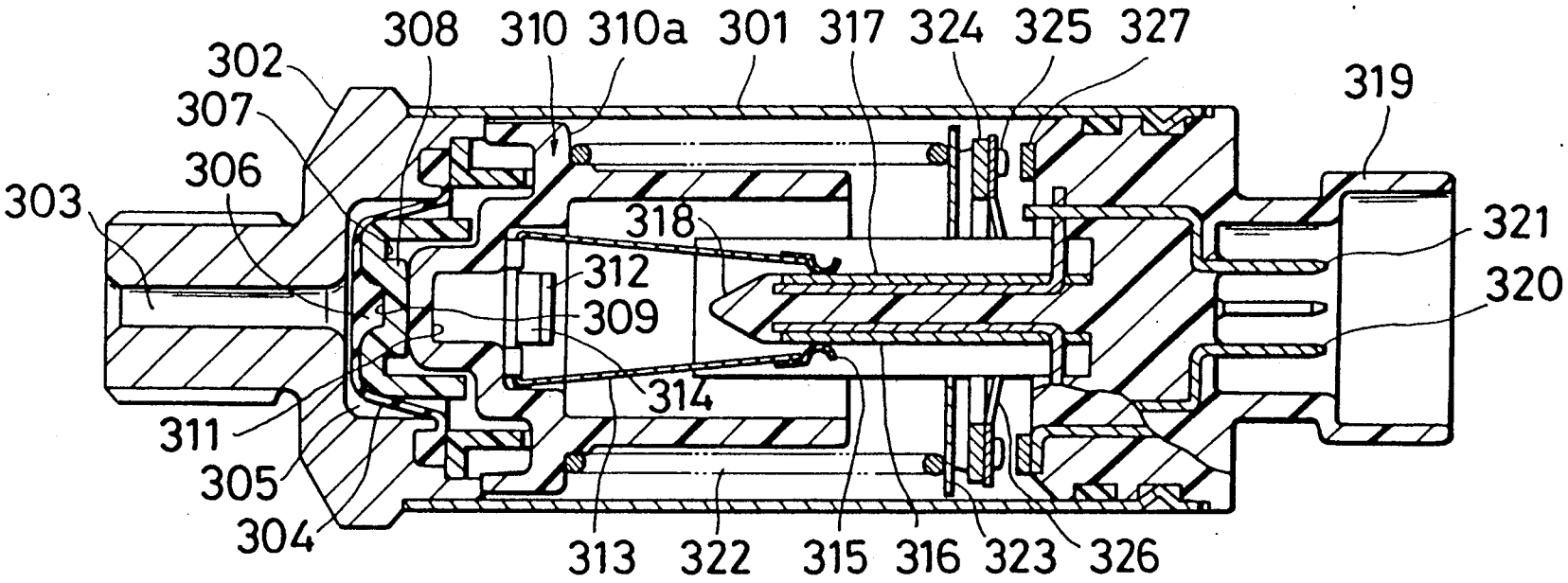
FIG. 33 to FIG. 35 show a seventh preferred embodiment.
Figure 34:
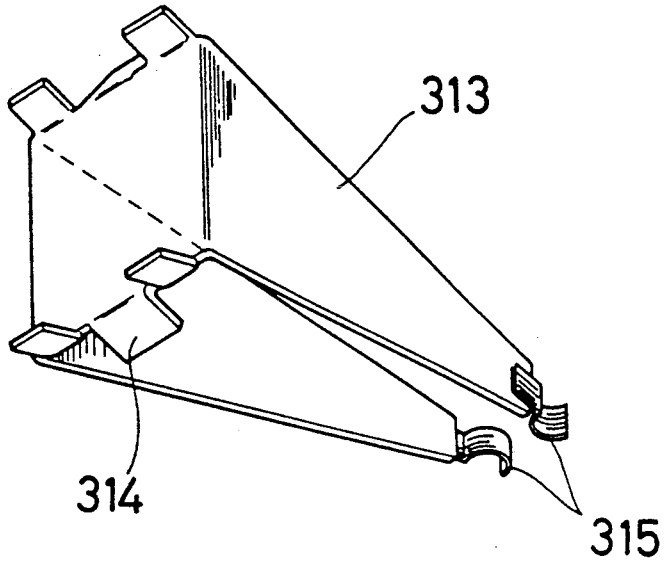
Figure 35:
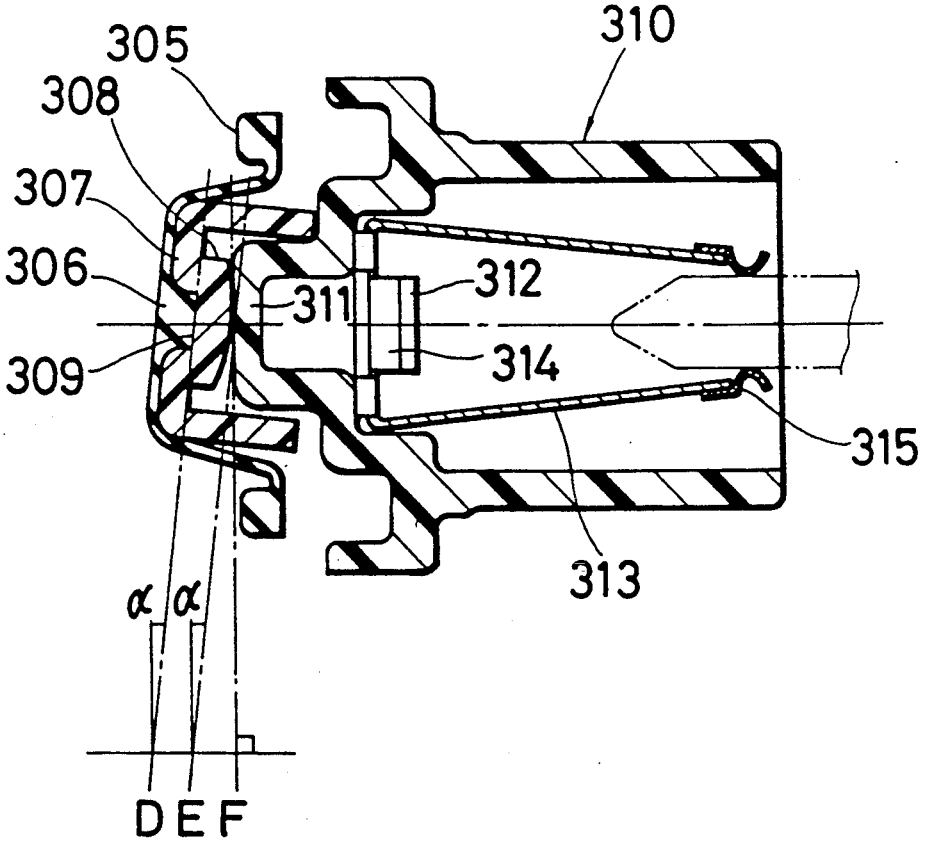

FIGS. 33 to 35 show another embodiment of the present invention. FIG. 33 shows one oil pressure sensor. The integrated fuel pump switch can not be looked at. The oil pressure passage 303 is made in the axle center portion of the mouth metal 302 which is inserted into the outlet of the cylindrical portion 301. The diaphragm 305 is installed in the recess 304 of the mouth metal 302 to cover the outlet portion of the cylindrical portion 301. The thick portion 306 projects at the central portion of the diaphragm 305. The push bottom 307 is an element with the bottom and projects in the bottom center to the inner direction of the cylindrical portion 301. The summit surface thereof has the curved boss portion 308. The thick portion 306 is inserted into the reces 309 formed in the boss portion 308 of the diaphragm 305. The bottom portion 311 of the slider 310 contacts with the curved portion formed in the boss portion 308 of the push botton 307. There is formed the contacting recess portion 312 in the inside of the bottom portion 311. A plate spring shaped slide contact plate 313 with the sectional view of substantial Letter " " is installed in the contacting reces portion 312 by contacting a nail 314. As shown in FIG. 34 the slide contact plate 313 has the wire brush 315 formed at the tip end portion thereof and slides on the surfaces of the flat resistor 316 and the earth conductor 317. Th flat resistor 316 and the earth conductor 317 are installed on the boss portion 318 fixed at the inside portion of the cylindrical other end portion and contact with the other end portion of the terminals 320 and 321 one end of which is housed within the coupler portion 319 integrally made with the boss portion 318. A coil shaped return spring 322 is wound around the circumference of the slider 310 and one end thereof is supported by the flange portion 310 and the other end is supported by the retainer 323 provided around the circumference of the boss portion 318. The retainer 323 is integrated with a movable plate 324 which is freely inserted to the circumference of the boss portion 318. The slider 310 is biased by the coil spring 322 to the left as viewed in FIG. 33. The movable contact 325 and a dished shaped return spring 326 in the movable plate 324 and the fuel pump switch is composed of the fixed contact 327 provided on the base side of the boss portion.

Function of the present embodiment will be described in the following. According to FIG. 33, when the oil pressure is supplied from the oil pump to the diaphragm 305 through the oil pressure passage 303, the diaphragm 305 moves to the right direction in the drawing and to such a position as the oil pressure balances with the resilient force of the coil spring 322. The push bottom 307 integral with the diaphragm 305 and the slider 310 contacting with the push bottom 307 move to the right direction against the coil spring 322. As shown in FIG. 35 the push surface D of the diaphragm 305 inclines at angle $\alpha$ degree to the actuating axis direction and the tangential surface E of the push bottom 307 inclines at angle $\alpha$ degree. However, the boss portion 308 of the push bottom 307, with which the slider 310 contacts, is formed as the curved portion and the slider 310 contacts with the boss portion 308 through the curved surface so that the tangential surface F does not incline to the boss portion 308 of the slider 310 push botton and moves under such a condition as it is vertical to the original actuating direction. As the slide contact plate 313 integral with the slider 310 can keep the predetermined angle in respect to the flat resistor 316 and the earth conductor 317, the contacting pressure of the wire brush 315 is substantially constant and it is hard for the wire brush to partially wear and to deform.

We claim:

1. A hydraulic actuating apparatus comprising:

a cylindrical case having a fitting at one end connectable to a source of pressurized oil, said fitting having a passage for communication with the pressurized oil;

a slider slidably carried by said cylindrical case, said slider being slidable in response to the oil pressure;

first spring means for biasing said slider in a predetermined direction to resist the force on said slider applied by the oil pressure;

slidable contact means carried by said slider;

an oil pressure sensor which includes a resistor and a ground conductor, said slidable contact means being slidably engaged with said resistor, said resistor being fixed with respect to said slidable contact means;

second spring means for biasing said slider in said predetermined direction, said second spring means being connected to said slider, said second spring means having a smaller spring constant than said first spring means;

a fuel pump switch having a movable contact and a fixed contact, movement of said movable contact relative to said fixed contact causing one of contact and release of said fuel pump switch, and said fuel pump switch is assembled integrally in said case, and said resistor comprises a flat resistor.

2. A hydraulic actuating apparatus as claimed in claim 1, wherein said slidable contact means comprises a wire brush.

3. A hydraulic actuating apparatus as claimed in claim 1, further comprising a diaphragm disposed between said slider and said source of pressurized oil, and said slider including a curved contact portion which engages said diaphragm.

4. A hydraulic actuating apparatus as claimed in claim 1, wherein said flat resistor includes a plurality of conductors which are disposed within a sliding zone of said slidable contact means and which are spaced apart in a direction generally parallel to the direction of sliding movement of said slidable contact means.

5. A hydraulic actuating apparatus as claimed in claim 1, further comprising pressure equalizing means for relieving pressure increase within said case caused by movement of said slidable contact means.

6. A hydraulic actuating apparatus as claimed in claim 5, wherein said pressure equalizing means includes a pipe which is in communication with both the inside of said case and ambient fluid outside said case.

7. A hydraulic actuating apparatus as claimed in claim 5, wherein said pressure equalizing means comprises an opening which is in communication with the inside of said case and with an equalizing element which covers said opening, and which is made of material which is resiliently deformable and waterproof.

8. A hydraulic actuating apparatus as claimed in claim 5, where said pressure equalizing means is disposed adjacent a side portion of said fuel pump switch.

9. A hydraulic actuating apparatus as claimed in claim 5, wherein said pressure equalizing means is disposed in series with said fuel pump switch.

10. A hydraulic actuating apparatus as claimed in claim 7, wherein said equalizing element comprises a further diaphragm which covers said opening.

11. A hydraulic actuating apparatus as claimed in claim 7, wherein said equalizing element comprises a film which is mounted to cover said opening and which permits passage only of air while stopping passage of liquids therethrough.

12. A hydraulic actuating apparatus as claimed in claim 7, wherein said opening is disposed in a coupler which is installed in a side of said case which is in a direction of movement of said slider which corresponds to increasing movement of said slider due to increasing oil pressure.

13. A hydraulic actuating apparatus as claimed in claim 7, further comprising a coupler connected to said case, and wherein said opening is disposed in a side wall portion of said case near said coupler.

14. A hydraulic actuating apparatus as claimed in claim 7, wherein said element comprises a bellows covering said opening.

15. A hydraulic actuating apparatus as claimed in claim 14, wherein said bellows has an outer, bendable portion having an open end which is in communication with said opening, and further comprising a hard ring which is disposed in the inside of said bellows.

16. A hydraulic actuating apparatus comprising:

a case;

a slider slidably carried by said case for movement relative to said case, in response to applied oil pressure;

a first spring means for controlling said slider movement in response to the applied oil pressure;

slidable contact means installed in said slider for making electrical contact between a movable portion which is moved by said slider and a flat resistor;

an oil pressure sensor which includes said flat resistor and a ground conductor which are installed in said case and are slidably in contact with said slidable contact means;

a press element connected to said first spring means, and second spring means for controlling movement of said slider, said second spring means being connected to said first spring means through said press element, said second spring means having a smaller spring constant than that of said first spring means;

a fuel pump switch which includes a movable contact and a fixed contact which contacts and releases therewith through movement of said press element;

pressure equalizing means for equalizing an interior pressure within said case with ambient pressure outside said case, to equalize a pressure increase caused by movement of said slider;

said pressure equalizing means and said fuel pump switch being disposed within said case;

a coupler disposed in one end portion of said case, said one end portion of said coupler extending into the interior of said case, and said fuel pump switch being integrally connected to said one end portion;

a stationary body supporting said flat resistor and said ground conductor provided in said one end portion of said coupler; and one end portion of said ground conductor is electrically connected to said case.

17. A hydraulic actuating apparatus as claimed in claim 16, wherein said ground conductor is electrically connected to said case such that one end portion of said ground conductor extends in a direction toward the inside of said case;

said one end portion of said ground conductor contacts an outer circumference of said one end portion of said coupler; and said one end portion of said coupler extends into a coupler end portion of said case and a portion of said ground conductor is urged into contact with the inside of said case.

18. A hydraulic actuating apparatus as claimed in claim 17, wherein said ground conductor is fixed to said case and to said coupler by clamping.

19. A hydraulic actuating apparatus as claimed in claim 17, wherein said one end portion of said ground conductor has a curved deformable portion.

* * * * *